US010351275B2

(12) United States Patent
Elliott

(10) Patent No.: US 10,351,275 B2
(45) Date of Patent: Jul. 16, 2019

(54) TENSION HEAD WITH TENSION WHEEL CAM BIASING ELEMENT FOR MODULAR STEEL STRAPPING MACHINE

(71) Applicant: Signode Industrial Group LLC, Glenview, IL (US)

(72) Inventor: Dustin D. Elliott, Grayslake, IL (US)

(73) Assignee: SIGNODE INDUSTRIAL GROUP LLC, Glenview, IL (US)

( * ) Notice: Subject to any disclaimer, the term of this patent is extended or adjusted under 35 U.S.C. 154(b) by 444 days.

(21) Appl. No.: 15/076,009

(22) Filed: Mar. 21, 2016

(65) Prior Publication Data

US 2016/0332756 A1 Nov. 17, 2016

Related U.S. Application Data

(60) Provisional application No. 62/160,358, filed on May 12, 2015.

(51) Int. Cl.
*B65B 13/22* (2006.01)
*B65B 13/32* (2006.01)
(Continued)

(52) U.S. Cl.
CPC ..... *B65B 13/22* (2013.01); *B65B 13/32* (2013.01); *B65H 20/02* (2013.01); *B65H 51/10* (2013.01);
(Continued)

(58) Field of Classification Search
CPC ..... B65B 13/22
(Continued)

(56) References Cited

U.S. PATENT DOCUMENTS 4,527,379 A * 7/1985 Bartzick ..... B29C 66/1122 100/29
5,459,977 A 10/1995 Haberstroh
(Continued)

FOREIGN PATENT DOCUMENTS

CN 104507813 A 4/2015
EP 1151921 A2 11/2001
(Continued)

OTHER PUBLICATIONS

International Search Report issued by ISA/EPO in connection with PCT/US2016/031695 dated Jul. 28, 2016.

*Primary Examiner* — Shelley M Self
*Assistant Examiner* — Christopher B Wehrly
(74) *Attorney, Agent, or Firm* — Levenfeld Pearlstein, LLC

(57) ABSTRACT

A self-actuating tension head for a strapping machine for feeding a steel strapping material around a load, tensioning the strapping material and sealing the strapping material to itself has a tension wheel biasing element. The tension head includes a body defining a strap path therethrough, a drive wheel, a tension wheel and a pinch wheel. The strap path extends between the tension wheel and the pinch wheel. The drive wheel is a fixed distance from the tension wheel. The drive and tension wheels are operably engaged with one another. A pivoting link operably connects the drive and tension wheels. The link pivots about the drive wheel axis of rotation. A cam is operably mounted to the tension wheel, and engages a cam follower to pivot the link to move the tension wheel into and out of engagement with the pinch wheel. The tension wheel biasing element cooperates with the cam to maintain the cam in a position relative to the cam follower.

13 Claims, 24 Drawing Sheets

(51) Int. Cl.
*B65H 20/02* (2006.01)
*B65H 51/10* (2006.01)
*B65B 13/04* (2006.01)

(52) U.S. Cl.
CPC .... *B65B 13/04* (2013.01); *B65H 2301/51432* (2013.01); *B65H 2404/143* (2013.01); *B65H 2404/1451* (2013.01); *B65H 2404/531* (2013.01); *B65H 2701/1944* (2013.01)

(58) Field of Classification Search
USPC ..... 100/29, 32; 140/93.2
See application file for complete search history.

(56) References Cited

U.S. PATENT DOCUMENTS

| | | | | |
|---|---|---|---|---|
| 8,701,555 | B2 | 4/2014 | Bell, Jr. | |
| 2003/0221566 | A1 | 12/2003 | Apel et al. | |
| 2007/0131496 | A1 | 6/2007 | Nix et al. | |
| 2012/0167532 | A1* | 7/2012 | Haberstroh | B65B 13/18 53/588 |
| 2013/0276415 | A1* | 10/2013 | Haberstroh | B65B 13/04 53/589 |
| 2013/0284033 | A1 | 10/2013 | Bell, Jr. | |
| 2015/0144215 | A1* | 5/2015 | Bellofatto | A61B 1/015 137/625.69 |

FOREIGN PATENT DOCUMENTS

| | | | |
|---|---|---|---|
| GB | 2072128 | A | 9/1981 |
| GB | 2481724 | A | 1/2012 |

* cited by examiner

TENSION HEAD WITH TENSION WHEEL CAM BIASING ELEMENT FOR MODULAR STEEL STRAPPING MACHINE

CROSS-REFERENCE TO RELATED APPLICATION DATA

This application claims the benefit of and priority to Provisional U.S. Patent Application Ser. No. 62/160,358, filed May 12, 2015, the disclosure of which is incorporated herein in its entirety.

BACKGROUND

Strapping machines, both automatic and manual, are known for securing straps around loads.

Steel strap can be used to secure loads, such as structural steel members, pipe, steel coils, metal plates and like materials that could otherwise overload or compromise the integrity and/or strength of plastic strap material. Typically, a hand-held tensioning tool is positioned on the load and the strap is positioned in the tool and tensioned. A seal is then applied to the strap to secure the tensioned strap around the load.

The seals can be of the crimp-type, in which a seal element is positioned around overlying courses of strap material and crimped onto the strap. Alternately, a crimpless seal, which uses a set of interlocking cuts in the strap can be used. Alternately still, a spot weld can be used to join the two ends of the strap. The hand-held tools can be fully manual or can be powered, such as by pneumatic motors, electric motors or the like.

Welding steel strap is also known, and is currently done using spot weld and inert-gas (i.e., TIG) welding processes to join feed coils together to maintain a continuous manufacturing process.

Haberstroh, US Publication 2013/0276415, commonly assigned with the present application discloses a modular steel strapping machine that applies, tensions and welds a strap to itself in an end-to-end weldment around a load. In order to tension the strap, a device, for example, a self-actuating tension head, such as that disclosed in Bell, Jr., U.S. Pat. No. 8,701,555 draws tension in the strap during the strapping cycle.

During the strapping cycle, following tensioning the strap, the tension on the strap must be relaxed a short predetermined distance so that the welding cycle can properly function. Although the tension head in Bell functions well in operation, it does not provide a way in which the strap tension can be relaxed (or the strap rolled back) for welding.

Accordingly, there is a need for an tension head for a strapping machine that draws tension in steel strap during the strapping cycle and secures the strap as required for proper function of the strapping machine, and specifically for the feeding and welding cycles of the strapping machine. Desirably, such a tension head provides a measured amount of rollback so that the welding cycle is properly carried out and resets to properly position the tension head for subsequent operations.

SUMMARY

A self-actuating tension head is configured for a strapping machine for feeding a steel strapping material around a load, tensioning the strapping material and sealing the strapping material to itself.

An embodiment of the tension head includes a body defining a strap path therethrough, a drive wheel defining an axis of rotation and a tension wheel defining an axis of rotation. The drive wheel axis of rotation is a fixed distance from the tension wheel axis of rotation. The drive and tension wheels are operably engaged with one another.

A pinch wheel defines an axis of rotation. The strap path extends between the tension wheel and the pinch wheel.

A first link operably connects the drive wheel and the tension wheel. The first link defines a first pivot arm. In an embodiment, the first link is formed as a pivoting plate and the tension wheel mounted to the plate for pivoting with the plate. A second pivot arm is defined between the axes of the tension wheel and the pinch wheel. The first and second pivot arms define an energizing angle therebetween. The energizing angle decreases as the tension wheel is moved into engagement with the pinch wheel.

A drive is operably connected to the drive wheel. The tension drive and body can be connected to one another by a releasable latch.

In an embodiment, the drive wheel is a drive gear and the tension wheel assembly includes a tension wheel assembly gear mounted to the tension wheel. The tension wheel assembly gear meshes with the drive gear to drive the tension wheel. The tension wheel can include a high friction surface.

In an embodiment, the first link or plate is biasedly mounted to the body to bias the tension wheel into engagement with the pinch wheel. In such an embodiment, rotating the tension wheel in a first (i.e., tension) direction urges the tension wheel into engagement with the pinch wheel, decreasing the energizing angle and increasing a normal force exerted by the tension wheel on the pinch wheel. Conversely, driving the tension wheel to rotate in the opposite direction (i.e., the feed direction) increases the energizing angle and opens a gap between the tension wheel and the pinch wheel to allow the strapping material to feed into the machine.

A cam is mounted to the tension wheel and is configured for engagement with a cam follower to rotate the first pivot axis to move the tension wheel out of engagement with the pinch wheel. The cam follower is mounted to a cover plate over the tension head. A biasing element cooperates with the cam to maintain the cam in a position relative to the cam follower.

In an embodiment, the cam is mounted to the tension wheel by a one-way clutch. The one way clutch permits the tension wheel to rotate free of the cam in the tension direction and engages the cam with the tension wheel in the opposite direction. The cam has a plurality of lobes and a plurality of valleys between adjacent lobes. The biasing element positions an upstream end of one of the valleys on the cam follower at a beginning of a tensioning cycle.

During a welding cycle, the tension head is configured to roll back or release the strap a small amount, about 7 mm, to accommodate the consumption of strap during the welding cycle. The biasing element maintains the cam in proper position so that following the tension cycle, the tension head rolls back to release the strap without the cam acting on the cam follower to open the tension head.

In an embodiment, the biasing element includes a polymeric element cooperating with the cam. The polymeric element can be operably mounted to the tension wheel by a spring washer. In an embodiment, the polymeric element is a polymeric disk and is positioned between a pair of washers forming a sandwich. The sandwich is operably mounted to the tension wheel by the spring washer. One suitable polymeric element is formed from a polytetrafluoroethylene material. Other suitable materials will be recognized by those skilled in the art.

In another embodiment, the biasing element is a spring biased plunger that is biased into engagement with the cam. The plunger can include a roller at an end thereof for engaging the cam.

The tension head can include a proximity sensor for determining when the tension wheel is moved into and/or out of engagement with the pinch wheel. The proximity sensor, when sensing that the tension wheel is out of engagement with the pinch wheel, generates a signal to the controller to stop rotation of the drive wheel.

These and other features and advantages of the present invention will be apparent from the following detailed description, in conjunction with the appended claims.

BRIEF DESCRIPTION OF THE DRAWINGS

FIG. 11 is a schematic illustration of the tension head showing how the tension head opens to allow strap to feed through;

DETAILED DESCRIPTION

While the present device is susceptible of embodiment in various forms, there is shown in the figures and will hereinafter be described a presently preferred embodiment with the understanding that the present disclosure is to be considered an exemplification of the device and is not intended to be limited to the specific embodiment illustrated.

Figure 1:
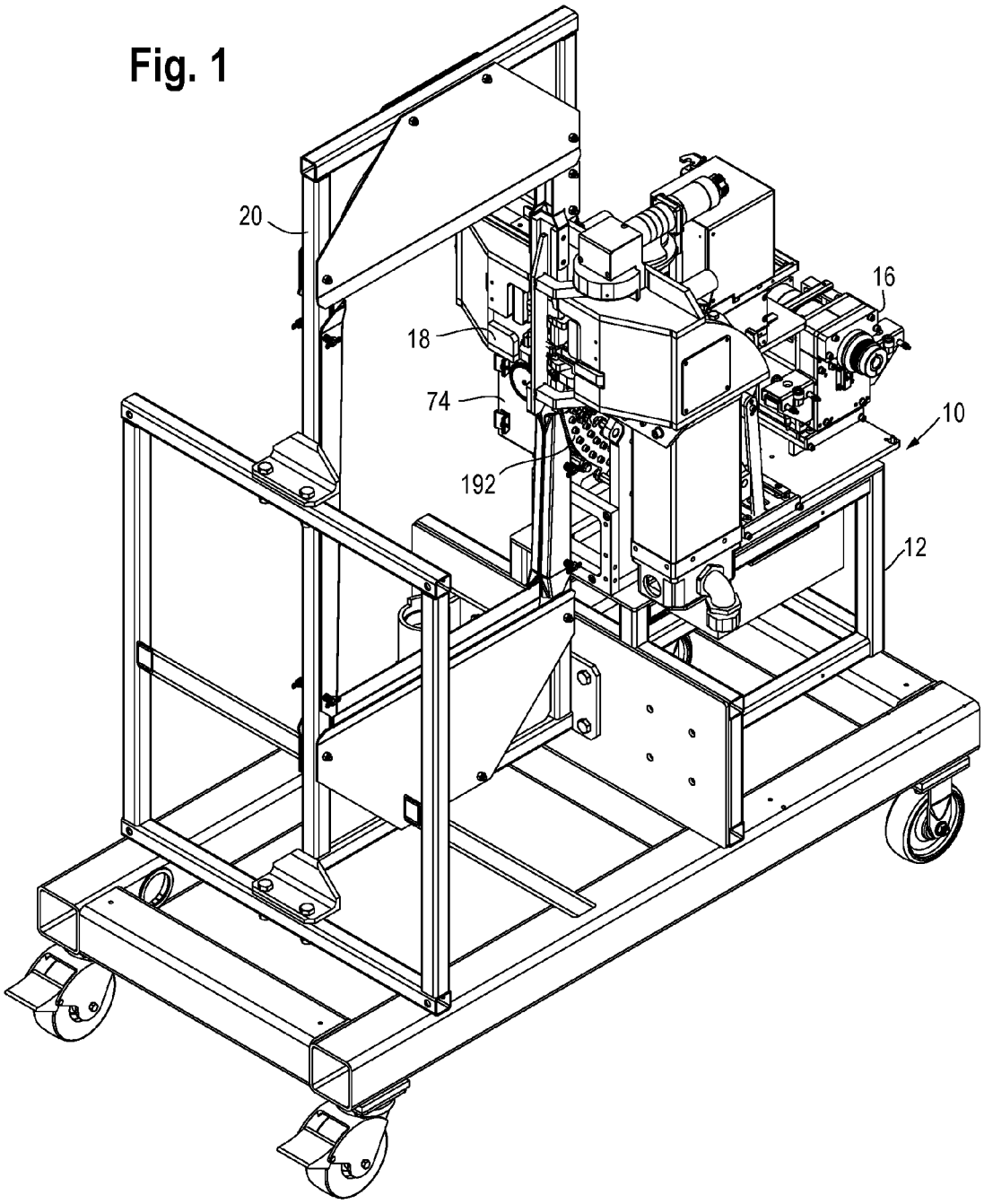
FIG. 1 is a perspective view illustrating the general layout of an example embodiment of a modular strapping machine for steel strap.

Referring to the figures and in particular to FIG. 1 there is shown an embodiment of a strapping machine 10. The strapping machine 10 is configured for use with steel strap S that can be tensioned and welded to itself in an end-to-end or butt weld to form a loop of strap around a load. The strapping machine 10 includes, generally, a frame 12, a feed head 14, a tension head 16, a strap straightener 17, a sealing or welding head 18 and a strap chute 20 through which the strap S is conveyed around the load. Strap S is fed from a strap supply such as a strap dispenser (not shown). Operation of the strapping machine 10 is controlled by a controller 22.

Briefly, in a typical operation, strap S is pulled from the dispenser and fed into the machine 10 by the feed head 14. The feed head 14 conveys the strap S through the tension head 16, through the strap straightener 17 and the sealing head 18, into and around the strap chute 20 and back to the sealing head 18 in a forward direction. The feed head 14 then operates in reverse to withdraw the strap S from the strap chute 20 onto the load.

Figure 2:
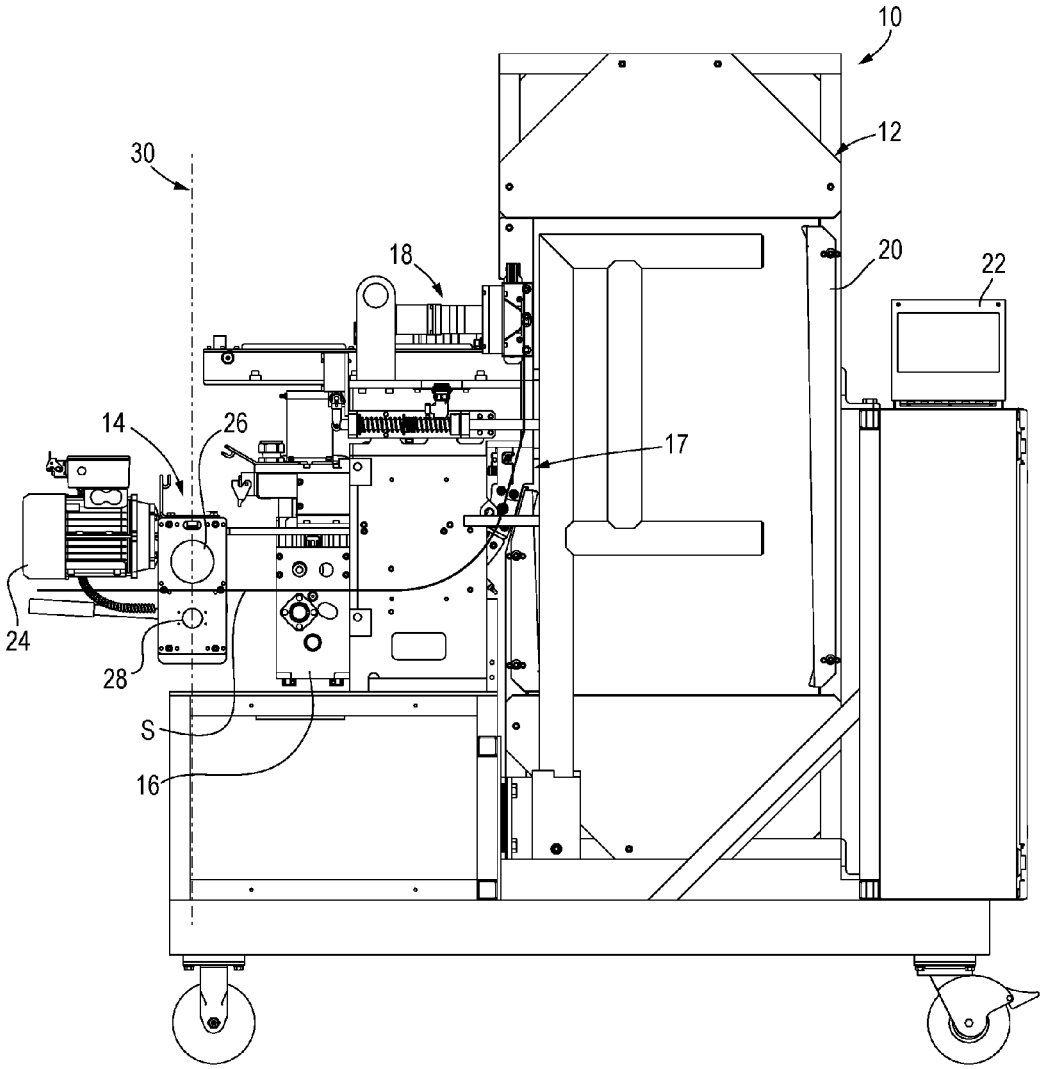
FIG. 2 is a front view of the strapping machine.
Figure 3:
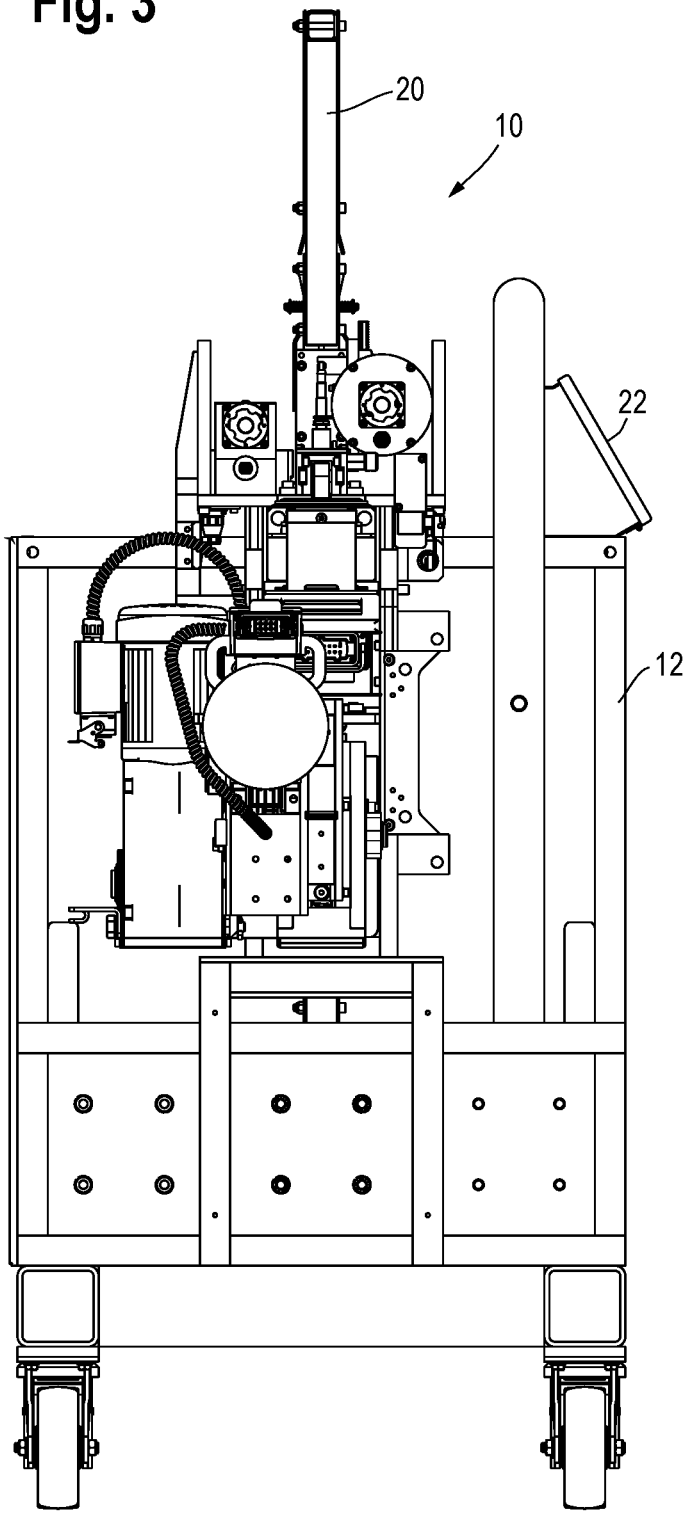
FIG. 3 is a side view of the machine.
Figure 5:
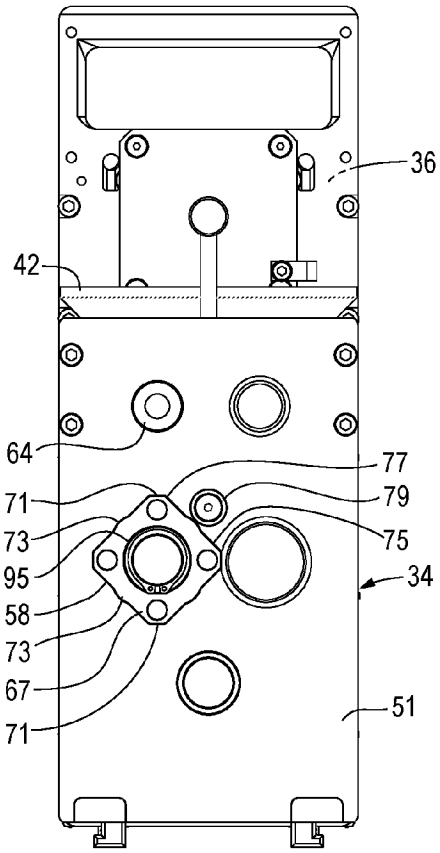
FIG. 5 is front view of the tension head.

The tension head 16 is configured to draw tension in the strap S as it is positioned around the load and to hold tension in the strap S at the commencement of the sealing cycle. As will be discussed below, and as seen in FIGS. 1 and 2, the strap S travels in a curved or arcuate path between the tension head 16 and the sealing head 18. As a result, during the tensioning cycle, and end-to-end curl can be induced in the strap S. The strap straightener 17 is configured to counteract this curl and to straighten the strap S to facilitate conveyance of the strap S through the sealing head 18 and strap chute 20.

With the strap S drawn in tension around the load, the sealing head 18 functions to cut the section of strap S from the supply, pull the strap ends toward one another, and weld the strap ends, end-to-end, to one another to form the strap loop. The load can then be discharged from the machine 10 and a subsequent load prepared for strapping.

It will be appreciated by those skilled in the art that the strap ends are welded in an end-to-end manner. As such, the strap ends (which are cut), do not have any of the typical coating materials on their surfaces. Accordingly, unlike know strap welding techniques, there is no need to prepare or otherwise treat the strap end surfaces prior to welding.

The feed head 14 includes a drive 24, a driven wheel 26 and an idler or pinch wheel 28. As noted above, the feed head 14 operates in the forward direction to feed strap S into the machine 10 and in the reverse direction to pull the strap S from the chute 20, onto the load and to consequently take up any slack strap S.

The illustrated feed head 14 is located remotely from the tension head 16 and the sealing head 18. This configuration allows the feed head 14 to be located outside of any enclosure 30 typically used for the tension 16 and/or sealing 18 heads and to be located on or near the frame 12 that carries the machine 10 components. It also allows the feed head 14 to be located at an elevation (e.g., near ground level) that permits ready access to the head 14 for maintenance, repair and the like.

Referring to FIGS. 4-13, the tension head 16 is of a self-actuating type and includes an electrical section 32 and a separate (mechanical) tension section 34. The electrical section 32 includes a drive 36, such as the illustrated electric motor, sensors 38 and the like. An output shaft 40 connects to the tension section 34. The electrical and tension sections 32 and 34 are connected to one another using a spring loaded latch 42 or like fastening system. This mounting or connection arrangement permits readily separating the electrical and tension sections 32 and 34 for ease of maintenance, repair and the like.

The tension section 34 includes a strap path (indicated generally at 44) through which the strap S traverses. The tension section 34 includes a drive wheel 46, a tension wheel assembly 48 and a pinch wheel 50. A cover plate 51 encloses the tension section 34. The drive wheel 46 is operably connected to the drive 36 by, for example, the motor output shaft 40. In a present embodiment, the drive wheel 46 is a drive gear and rotates in the clockwise direction to draw tension in the strap (see, e.g., FIG. 10). The tension wheel assembly 48 includes a tension wheel 52 that, in the present embodiment, has a friction surface 54. The friction surface 54 can be a roughened surface, for example, a diamond patterned surface to ensure a high friction force is created during the tension cycle.

The tension wheel assembly 48 includes a gear 56 that mates with the drive gear 46 to transfer power from the drive 36 to the tension wheel assembly 48. The tension wheel 52 and gear 56 are fixedly mounted to one another and can be mounted to a common shaft 58. In this manner, power is transferred from the drive 36 to the tension wheel 52 via the gear 56 and shaft 58.

The drive gear 46 and tension wheel assembly 48 are mounted to one another by a first link 62, that can be formed as a plate or carriage, as illustrated at 63. The first link 62 defines a first pivot arm $A_{62}$ that extends from the drive gear 46 axis though the tension wheel assembly 48 axis.

The pinch wheel 50 is mounted to a shaft 64 and is disposed about opposite the drive gear 46 for engaging the tension wheel 52 with the strap S between the wheels 50, 52. During the tensioning cycle, strap S is captured between the tension wheel 52 and the pinch wheel 50 and provides a surface against which the strap S is engaged to tension the strap S.

Figure 11:
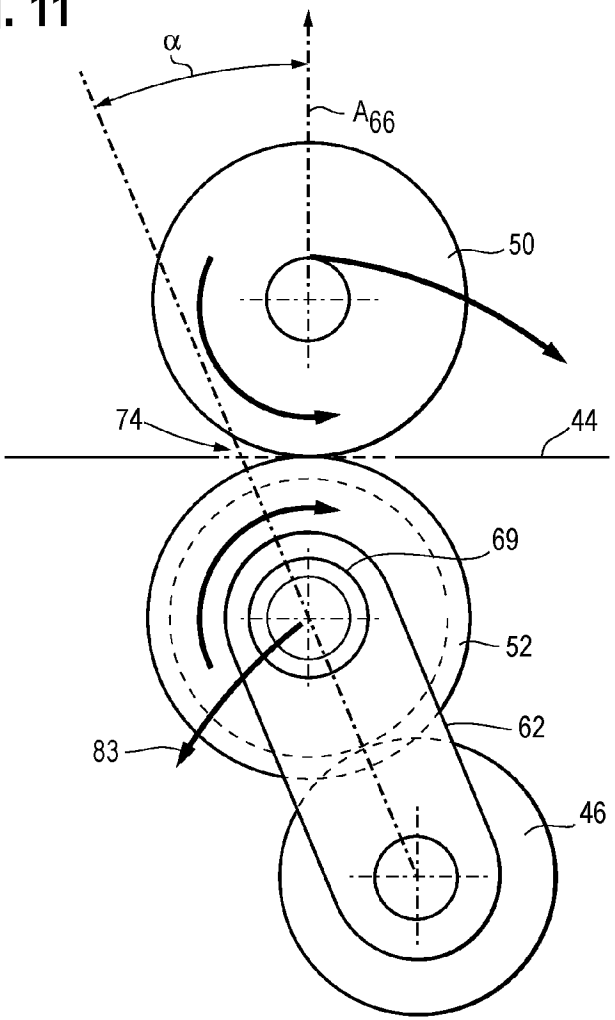

Referring to FIG. 11, a second pivot arm $A_{66}$ is defined between the tension wheel assembly shaft 58 and the pinch wheel shaft 46. The second pivot arm $A_{66}$ is at an angle $\alpha$, the energizing angle, to the first pivot arm $A_{62}$. A cam 67 is mounted to the tension wheel assembly shaft 58 by a one-way clutch 69. The one-way clutch 69 permits the tension wheel 52 to rotate free of the cam 67 when rotating in the tension direction (when the tension wheel 52 rotates counter-clockwise), but engages the cam 67 when rotating in the opposite direction (when the tension wheel 52 rotates in the clockwise direction).

The cam 67 has a plurality of cam lobes 71 with valleys or low spots 73 between the lobes 71. Each lobe 71 has an upstream face 75 and a downstream face 77. A cam follower 79 is mounted to the cover plate 51. The cover plate 51 has an enlarged or slotted opening 81 through which the shaft 58 extends. As the cam lobes 71 contact the cam follower 79, the shaft 58 (on which the cam 67 is mounted) is pivoted in a counter-clockwise direction (as indicated at 83 in FIG. 11) to pivot the tension wheel 52 and first linkage 62 (or plate 63) and tension wheel 52 out of contact with the pinch wheel 50.

Figure 10:
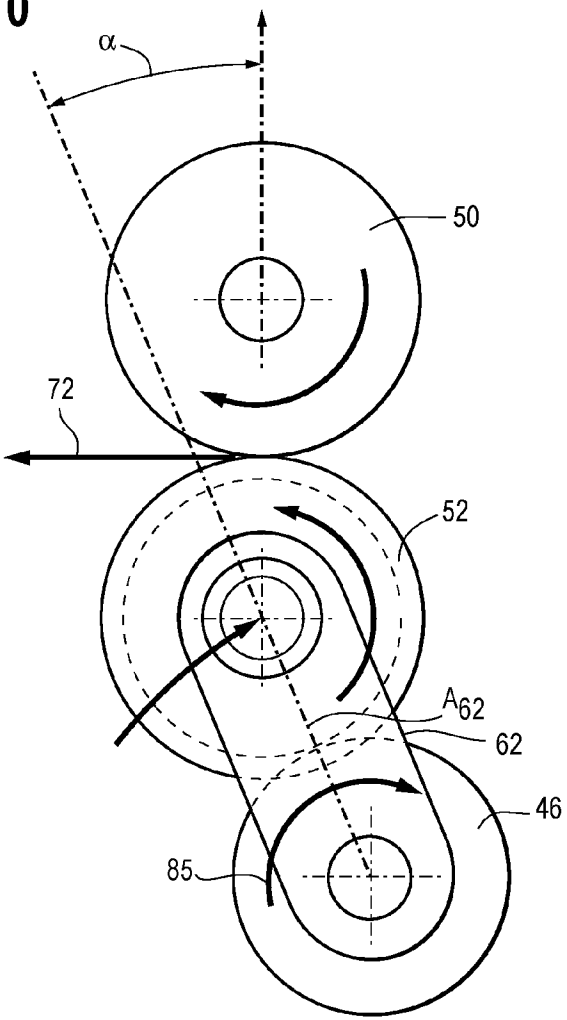
FIG. 10 is a schematic illustration of the tension head operating in the tension cycle.
Figure 12:
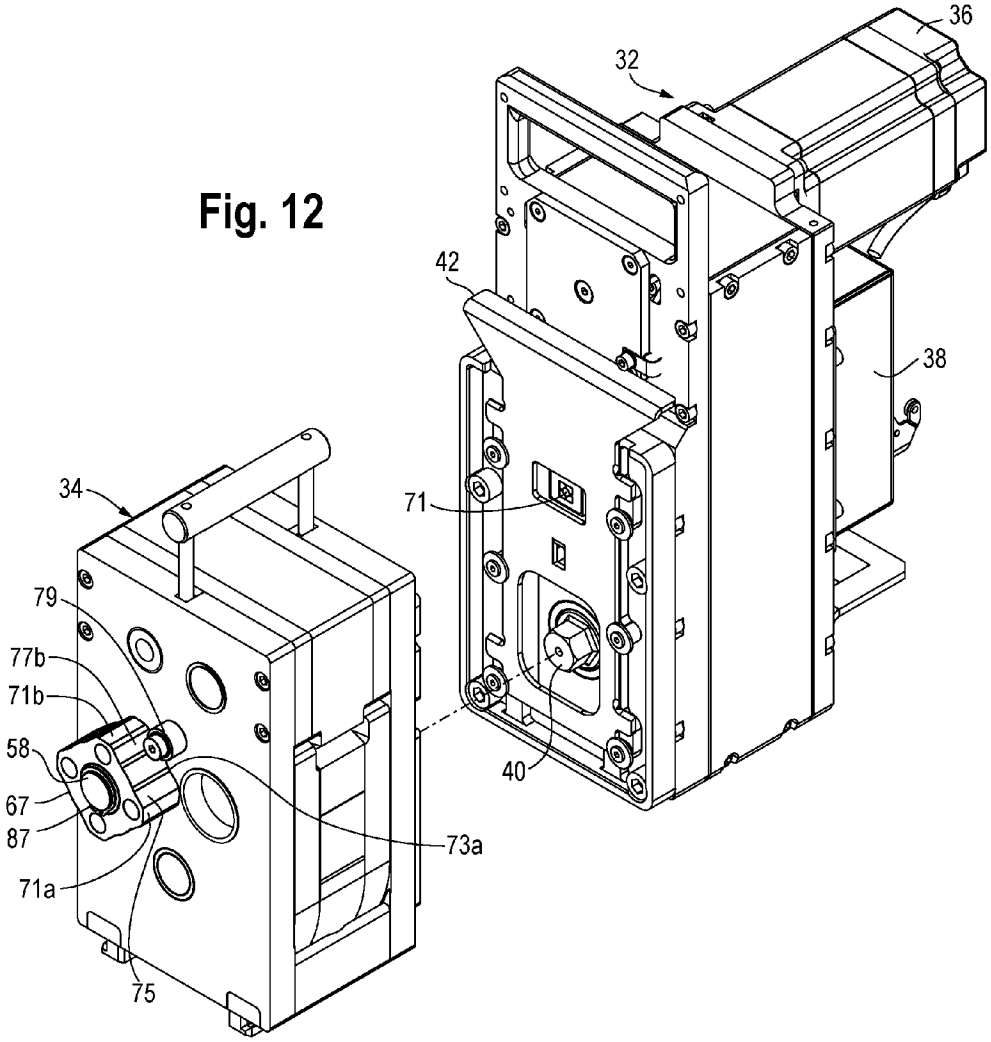
FIG. 12 shows the tension head and drive assembly separated from one another.

Both the drive wheel 46 (gear) and pinch wheel 50 are fixed transverse to their respective axes of rotation, but the tension wheel assembly 48 (the shaft 58) floats in the transverse direction by virtue of it being mounted to the first linkage 62 (or plate 63). In this manner, as illustrated in FIGS. 10 and 11, the energizing angle $\alpha$ varies dependent upon the "float" of the tension wheel assembly 48. A spring 70 biases the tension wheel 52 into contact with the pinch wheel 50.

At the beginning of and throughout the tension cycle, the cam upstream face 75 is resting against the cam follower 79. When operating in the tension cycle, as seen in FIG. 10, the drive 36 actuates, which rotates the drive gear 46 which, in turn, is meshed with the tension wheel assembly gear 56. As illustrated in FIG. 10, the drive 36 and drive gear 46 thus rotate in the clockwise direction (as indicated at 85) which rotates the tension wheel 52 in the counter-clockwise direction. With the strap S positioned between the tension wheel 52 and pinch wheel 50, the strap S is drawn to the left, in tension, as illustrated by the arrow at 72.

With the tension wheel 52 capturing the strap S (between the tension wheel 52 and pinch wheel 50), the tension wheel 52 rotates in the counter-clockwise direction, but the tension wheel to drive wheel link (the first link 62) will tend to pivot in the clockwise direction, and thus the tension wheel 52 will attempt to creep up on the pinch wheel 50. This is due to the floating mount of the tension wheel assembly 48 and the pivoting mount of the first link 62 (or plate 63). As the first link 62 pivots in the clockwise direction, the energizing angle a decreases, which increases the normal force of (and the pressure exerted by) the tension wheel 52 on the pinch wheel 50, thus increasing the grip on the captured strap S. Continued rotation of the tension wheel 52 draws tension in the strap S until a desired tension is achieved. Because the cam 67 is mounted to the tension wheel shaft 58 by the one-way clutch 69, it does not rotate with the tension wheel 52 in the counter-clockwise (tension) direction.

Once the desired tension is achieved, the tension head 16 is configured to permit a roll-back to "relax" the tensioned strap a predetermined amount. In a present embodiment, the tension head 16 permits roll-back or relaxes the strap about 7 millimeters (mm) to accommodate the need for a small amount (about 7 mm) of strap S consumed during the welding cycle.

To accomplish this roll-back, following the tension cycle, the tension drive 36 is reversed (operates in the counter-clockwise direction (as seen in FIG. 11). As noted above, when rotating in the counter-clockwise direction, the one-way clutch 69 between the cam 67 and the tension wheel shaft 58 engages so that the cam 67 moves with the tension wheel 52. As a result, as the tension wheel 52 rotates, the cam 67 also rotates. Because the cam 67 starts into the tension cycle with an upstream face 75 engaging the cam follower 79, the cam 67 will move through a valley 73 (for example, valley 73*a* between cam lobes 71*a* and 71*b*) and to the downstream face 77*b* of adjacent lobe 71*b*. During this movement, the tension wheel 52 is engaged with the pinch wheel 50 (with the strap S between the wheels) to reverse the strap direction to roll back the strap S.

As the cam downstream face 77*b* engages the cam follower 79, the force exerted by the cam 67 on the follower 79 acts to pivot the first link 62 (or plate 63) in the counter-clockwise direction, overcoming the spring 70 force (that biases the tension wheel 52 into contact with the pinch wheel 50). This opens a gap or space between the pinch 50 and tension 52 wheels (indicated generally at 74) which allows the strap S to move freely between the wheels 50 and 52. A proximity sensor 71 located in the tension head 16 (see FIG. 12) senses when the tension wheel 52 (as mounted to the first link 62) is pivoted away from the pinch wheel 50 and stops the drive 36 from continuing to drive the drive gear 46. The link 62 (and tension wheel 52) are maintained in this position during the welding cycle and into a subsequent feed cycle. Following completion of the welding cycle and subsequent feed cycle, prior to entering a subsequent tension cycle, the tension drive 36 continues rotation in the counter-clockwise direction until the cam 67 comes off of the lobe 71 and the pinch and tension wheels 50, 52 engage one another (with strap S between the wheels).

Figure 4:
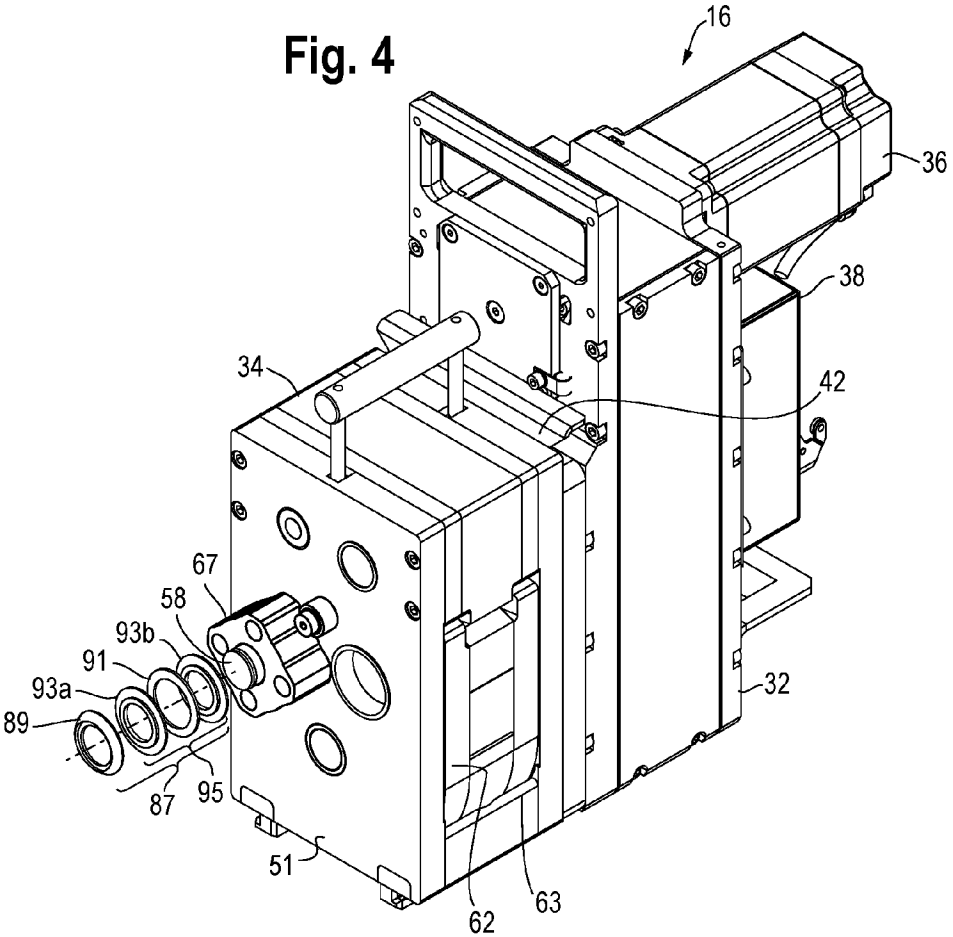
FIG. 4 is a perspective view of a tension head or tension module.
Figure 7:
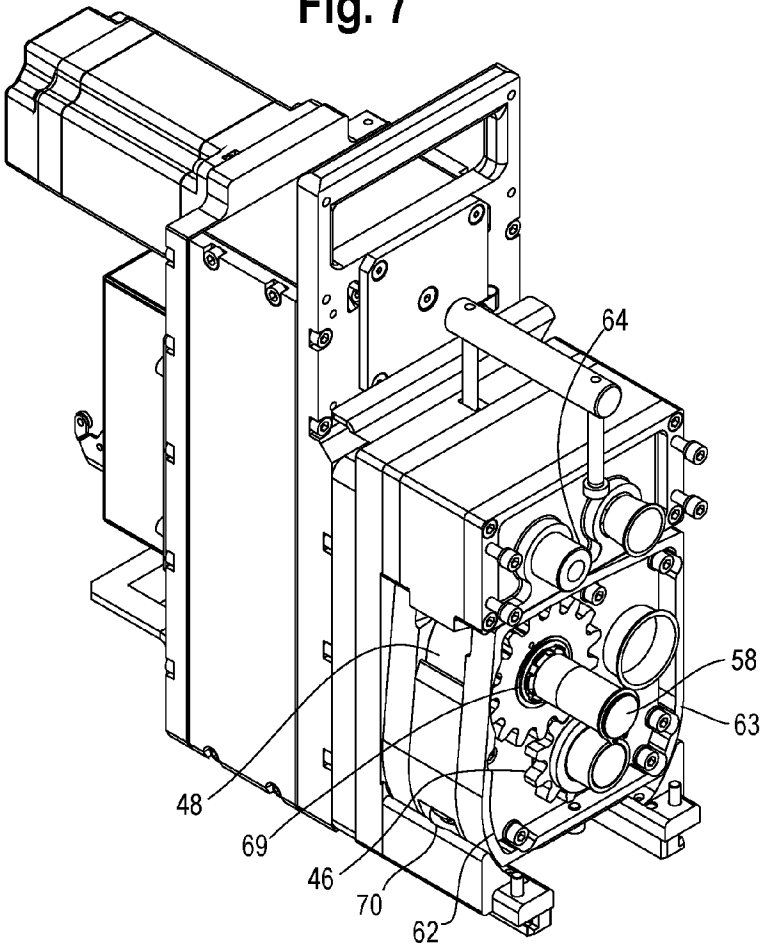
FIG. 7 is a partial perspective view of the tension head with the cover plate removed for clarity of illustration.
Figure 6:
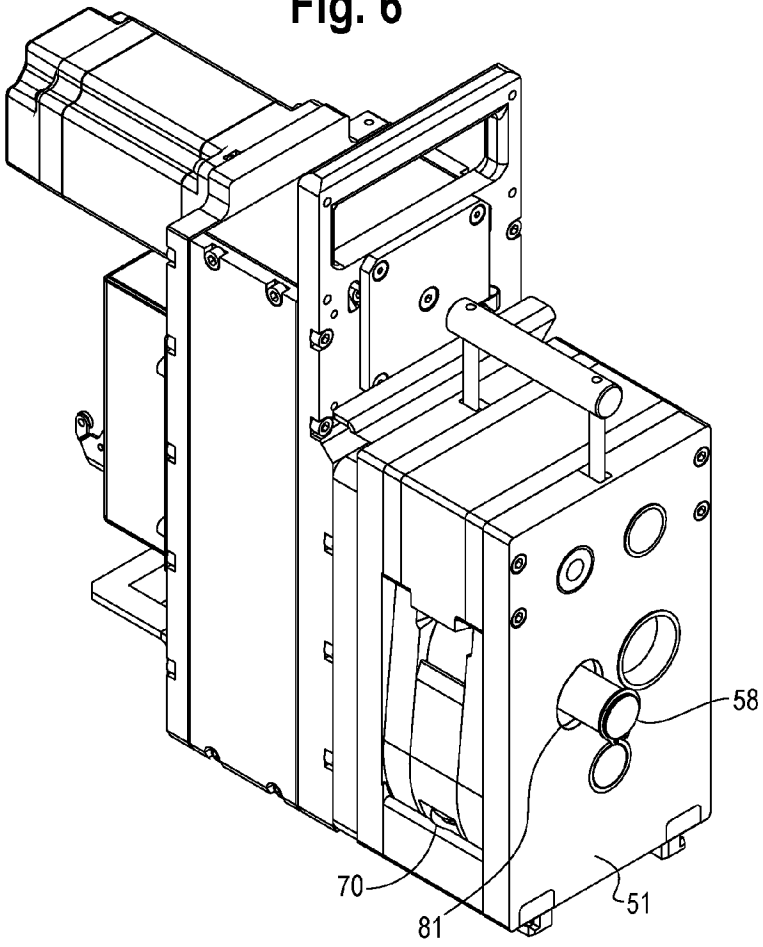
FIG. 6 is a partial perspective view of the tension head with the tension wheel cam removed for clarity of illustration.
Figure 9:
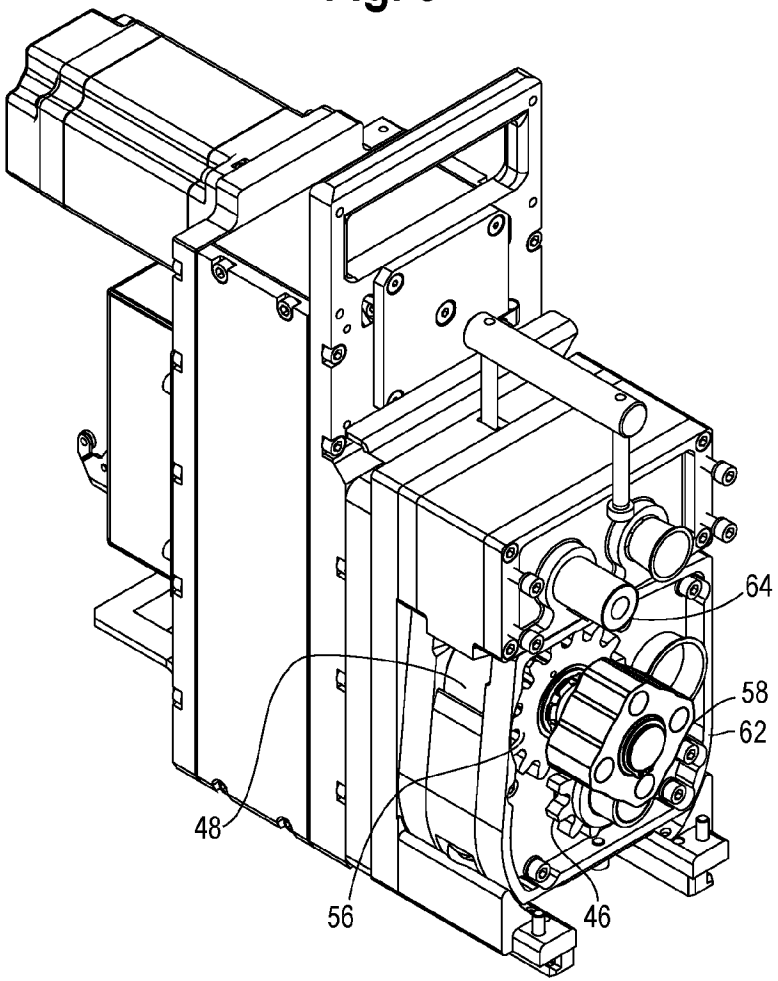
FIG. 9 is a perspective view illustrating the drive wheel to tension wheel assembly link (plate) mounted to the tension wheel and showing the cam mounted to the tension wheel assembly.
Figure 8:
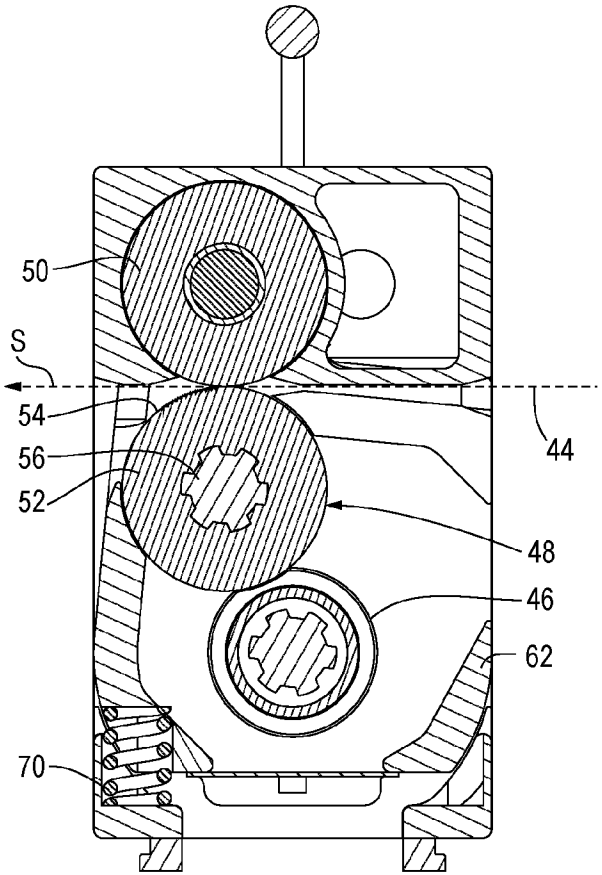
FIG. 8 is a front schematic illustration similar to FIG. 5 but with the cover removed for clarity of illustration.
Figure 14:
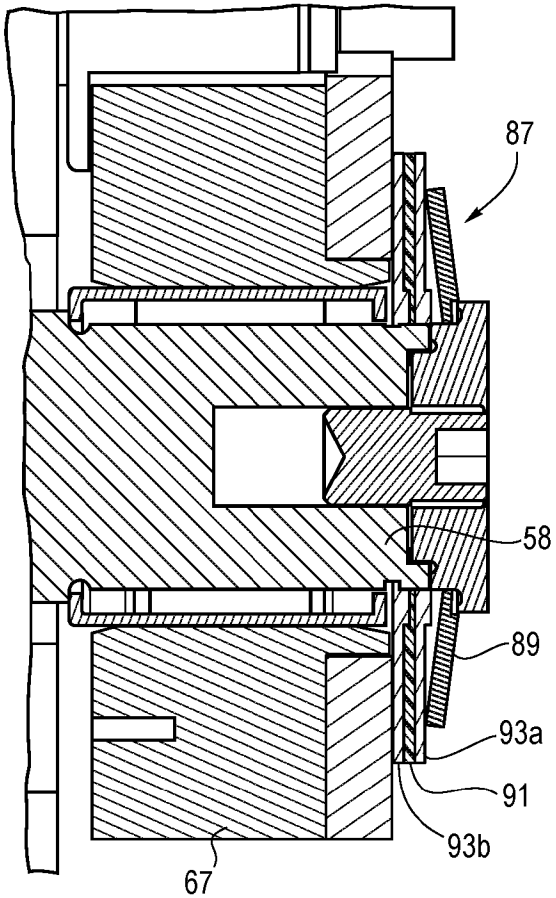
FIG. 14 is a cross-sectional view of the disk-type biasing assembly.

In order to assure that the cam 67 remains in the proper position to commence the tension cycle, referring to FIGS. 4 and 14, a cam biasing assembly 87 is operably mounted to the tension head 16. The biasing assembly 87 maintains the cam 67 in proper position (i.e., with the upstream face 75 resting on the cam follower 79) following the feed cycle, during the tensioning cycle and prior to roll-back, for proper functioning of the weld head 18 as described above.

In an embodiment, the cam biasing assembly 87 includes a spring washer 89 and a cooperating polymeric element 91, which in an embodiment is formed as a polymeric disk, positioned between the spring washer 89 and the cam 67. In this embodiment, the biasing assembly 87 includes a pair of metal washers 93*a,b*, one on either side of the polymeric disk 91, forming a sandwich 95 of the polymeric disk 91.In this embodiment, the sandwich 95 is held against the cam 67 by the spring washer 89, In such an arrangement, the biasing assembly 87 will maintain the cam 67 in position and will prevent free rotation or free-wheeling of the cam 67 as the tension wheel 52 rotates in the tension direction or due to machine vibration. The polymeric disc 91 will, however, permit the cam 67 to rotate with only a slight amount of drag when the one-way clutch 69 is engaged. As such, when the cam lobe 71 comes off of the cam follower 79 to commence the tension cycle, the cam 67 will remain in place with an upstream face 75 resting against the follower 79.

In an embodiment, the polymeric disc 91 is a low coefficient of friction material, such as a polytetrafluoroethylene (PTFE) material, for example, a RULON® material, commercially available from Saint-Gobain Performance Plastics Corp. of Aurora, Ohio. Other suitable polymeric materials will be recognized by those skilled in the art.

Figure 13:
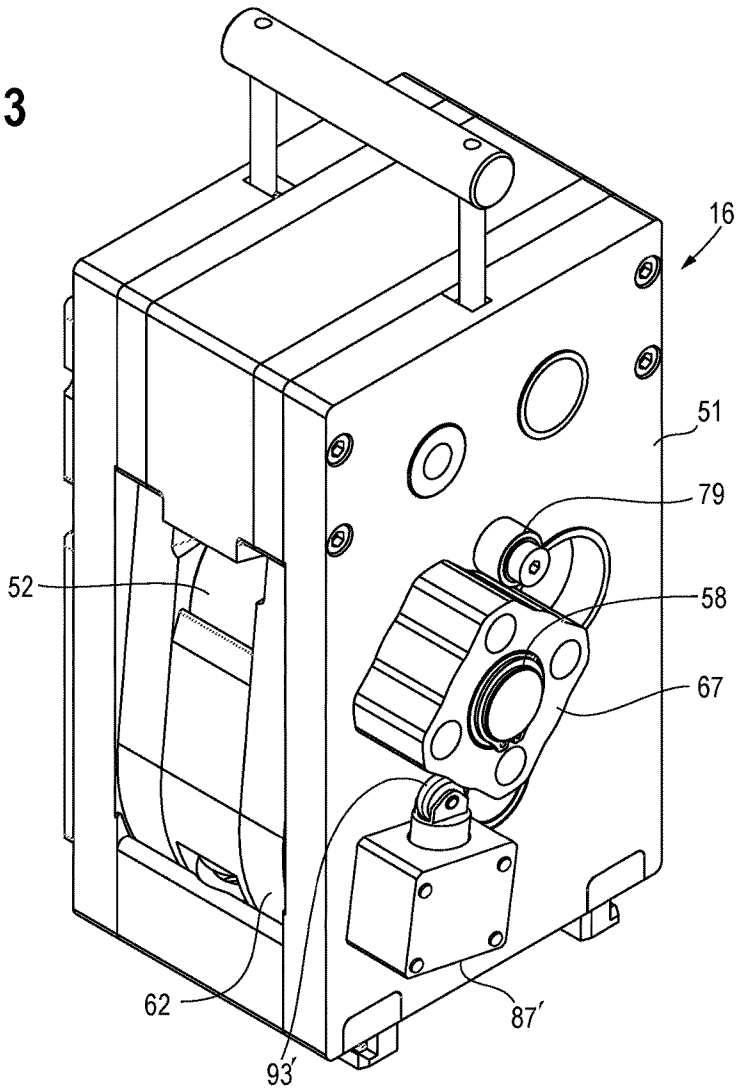
FIG. 13 is a perspective view of the tension head and showing an alternate, plunger-type biasing assembly.
Figure 15:
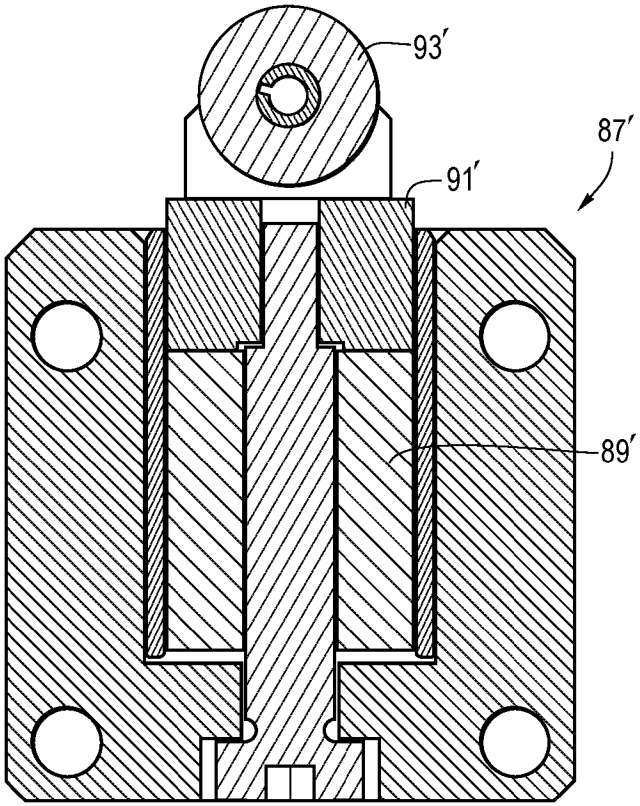
FIG. 15 is a cross-sectional view of the plunger-type biasing assembly of FIG. 13.

An alternate embodiment of the biasing assembly 87' is illustrated in FIGS. 13 and 15. In this embodiment, the assembly 87' includes a spring 89' biasing a plunger 91' having a roller 93' at an end thereof. The roller 93' rests against and rides on the cam 67 so as to prevent the cam 67 from inadvertent movement during the feed, tension and welding cycles and to assure that the cam 67 is properly positioned (with an upstream face 75 resting) on the follower 79 at the end of the tension cycle.

Figure 33:
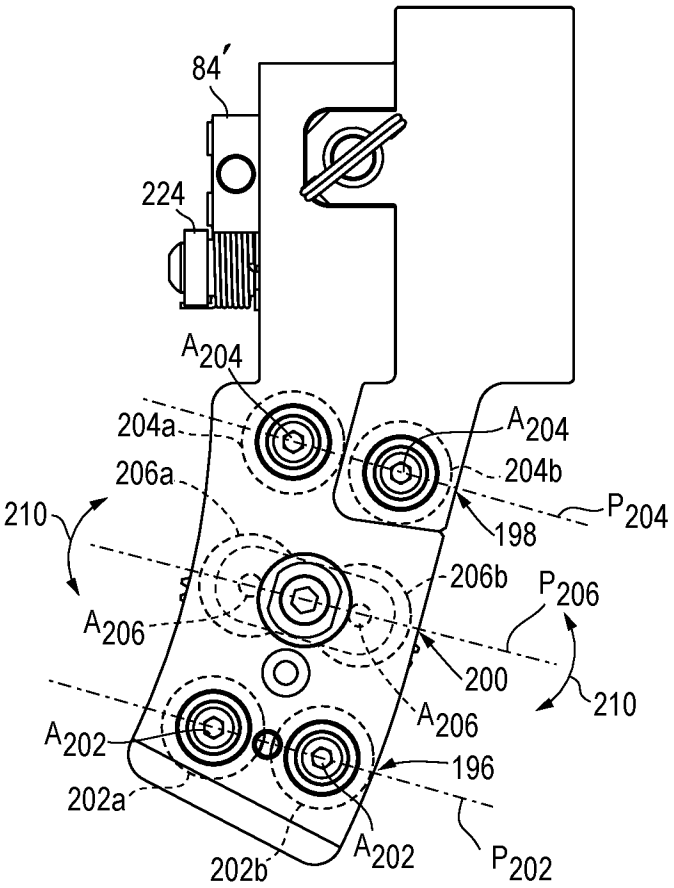
FIG. 33 is a front view of the strap straightener.
Figure 32:
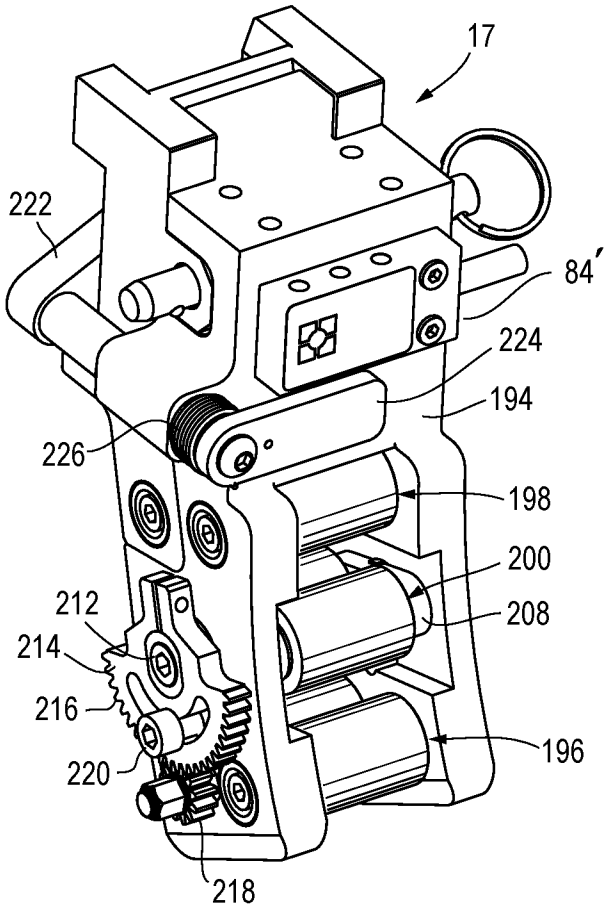
FIG. 32 is perspective view of the strap straightener.

Referring now to FIGS. 2 and 32-33, the strap straightener 17 is positioned between the tension head 16 and the sealing head 18. The strap straightener 17 is configured to straighten the strap S to counteract any end-to-end curl that may be induced in the strap as a result of, for example, the tensioning cycle. As can be seen from FIGS. 1 and 2, the path between the tension head 16 and the sealing head 18 is curved, reorienting the strap from a horizontal path from the feed head 14 to a vertical path at the sealing head 18 and strap chute 20. As a result, during the tension cycle, an end-to-end curl is induced in the strap due to the curved path and the tension drawn on the strap S. This end-to-end curl can result in misfed strap and strap jams.

The strap straightener 17 is provided to counteract the end-to-end curl by bending the strap S in a direction opposite of the induced end-to-end curl. The strap straightener 17 includes a body 194, an inlet guide element 196, an outlet guide element 198 and a movable straightening element 200. In a present configuration, the inlet guide element 196 includes a pair of spaced apart rollers 202*a* and 202*b*, and likewise, the outlet guide element 198 includes a pair of spaced apart rollers 204*a* and 204*b*. The rollers 202*a,b* and 204*a,b* of each element 196, 198 are at a fixed distance from one another and are fixed relative to the body 194. The roller axes $A_{202}$ and $A_{204}$ are fixed, such that a plane $P_{202}$ and $P_{204}$ through each axis pair $A_{202}$ and $A_{204}$ is fixed, and the planes $P_{202}$ and $P_{204}$ are fixed relative to one another.

The movable straightening element 200 also includes a pair of rollers 206*a* and 206*b*. The rollers 206*a* and 206*b* are mounted to a carriage 208 that is movable relative to the inlet and outlet guide elements 196, 198. In a present configuration, the carriage 208 is pivotable relative to the inlet and outlet guide elements 196, 198, as indicated by the double headed arrow at 210. In this manner, a plane $P_{206}$ through the axes pair $A_{206}$ of the movable element rollers 206*a* and 206*b* is movable relative to the fixed element roller planes $P_{202}$ and $P_{204}$.

To effect movement or pivoting of the carriage 208, the carriage 208 includes a stub shaft 212 extending therefrom. A pivot link 214 is mounted to the stub shaft 212, such that rotating or pivoting the pivot link 214 pivots the carriage 208 and thus the moveable straightening element 200. The pivot link 214 can include teeth 216, which can be meshed with a drive gear 218 to move the pivot link 214. The drive gear 218 can be driven by a drive, or manually driven. A fastener 220, such as the illustrated shoulder bolt can be used to secure the moveable element 200 into a desired position.

Figure 17:
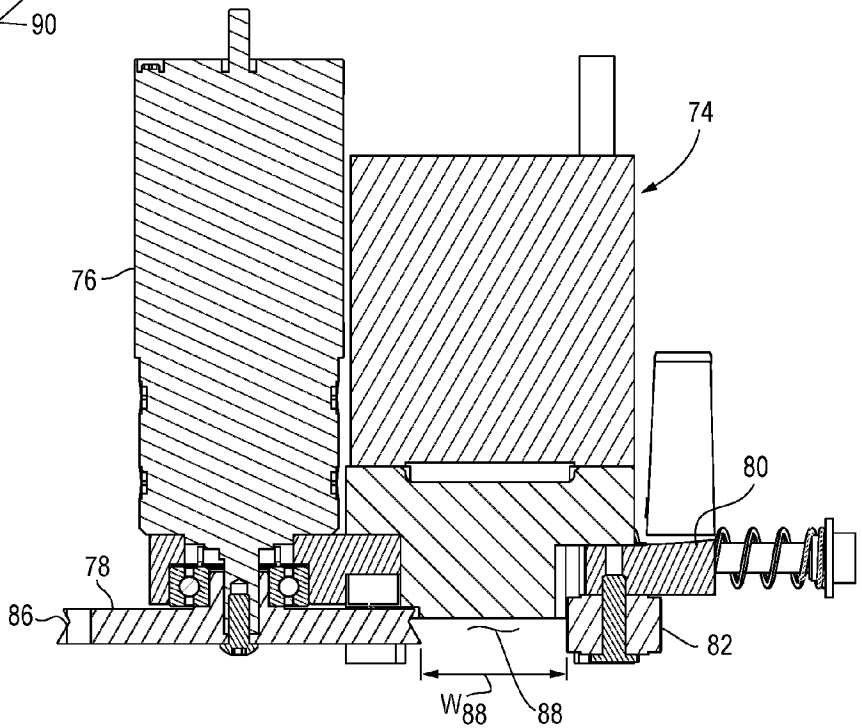
FIG. 17 is a partial sectional view of the feed limit assembly.
Figure 16:
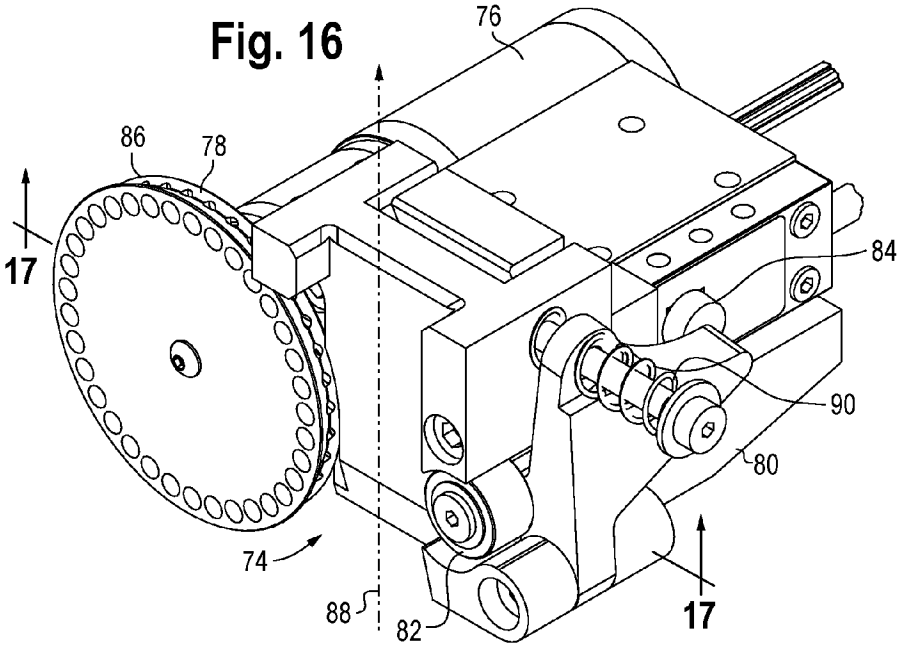
FIG. 16 is a perspective view of the feed limit assembly.

As illustrated in FIGS. 16-17, a feed limit assembly 74 is located in the strap path, at about the end of the strap chute 20 to receive the leading end of the strap S as the leading end is conveyed into the sealing head 18. The feed limit assembly 74 can be positioned adjacent to the strap straightener 17. The feed limit assembly 74 includes a drive 76, a drive wheel 78, a biased carriage 80 and roller 82, and a sensor 84. In a present embodiment, the drive wheel 78 has a notched or V-shaped edge or groove 86, and the roller 82 is positioned opposing the groove 86. The V-shaped groove 86 and roller 82 define a strap path, indicated generally at 88. The roller 82 is mounted to the biased carriage 80, which biases the roller 82 toward the wheel 78. Biasing of the carriage 80 can be, for example, by a spring 90. The strap path 88 has a predetermined width $w_{88}$ that, when the carriage 80 (and roller 82) are in a home position, is slightly less than a width of the strap S. Alternately, although not shown, the feed limit assembly can include a drive wheel with a one-way clutch bearing instead of a drive motor.

In a present embodiment, the sensor 84 is positioned adjacent to the carriage 80 so that the carriage 80 pivots into and out of contact (electro, electro-mechanical and/or mechanical contact) with the sensor 84. As strap S passes into the strap path 88, it rides in the groove 86 and contacts the roller 82 which, in turn, pivots the carriage 80 away from the sensor 84. In one embodiment, the sensor 84 is a proximity sensor.

As seen in FIGS. 32-33, the strap return sensor 84' can be positioned on the body 194 of the strap straightener 17. In this configuration, as the strap S returns toward the sealing head 18, the strap S contacts a limit flag 222 which is operably mounted to a sensor contact 224, that moves into contact with the sensor 84'. The limit flag 222 is biased into the strap path by a spring 226. This configuration of the strap sensor 84' and its components can be used in place of the pivoting carriage 80 of the embodiment of FIGS. 16-17.

As will be discussed in more detail below, the feed limit assembly 74 provides a number of functions. First, upon sensing that strap S has entered the strap path 88, the sensor 84 provides a signal to the controller 22 and/or feed head 14 to indicate that strap S is returning to the sealing head 18. Second, the feed limit assembly drive 76 and wheel 78 provide sufficient motive force on the strap S to assure that the leading end of the strap S is urged into the sealing head 18 and is properly positioned for sealing head 18 operation.

The sealing head 18 is illustrated in FIGS. 18-31. The sealing head 18 functions, in an overall sealing cycle, to receive the strap S as it passes through the head 18 and into the strap chute 20, receive the leading end of the strap S that returns from the chute 20, grasp or clamp both ends of the strap S, cut the strap from the supply to form a loop end of the strap, and weld the strap ends to one another in an end-to-end weld or seal. It will be understood from the present disclosure, and as discussed above, that the weld is an end-to-end weld, not an overlapping weld, that is carried out automatically and while the strap S is in tension around the load. To effect the end-to-end weld, as part of the sealing cycle, the sealing head 18 moves the two cut ends of the strap toward one another as the weld is carried out.

The sealing head 18 defines a strap path therethrough as indicated generally at 92. A number of assemblies are aligned along the strap path 92. A cam 94, located within the head 18, and driven by a cam drive 93, includes various lobes that cooperate with cam followers within the head 18 to move the assemblies through their respective cycles, as will be described below.

Figure 18:
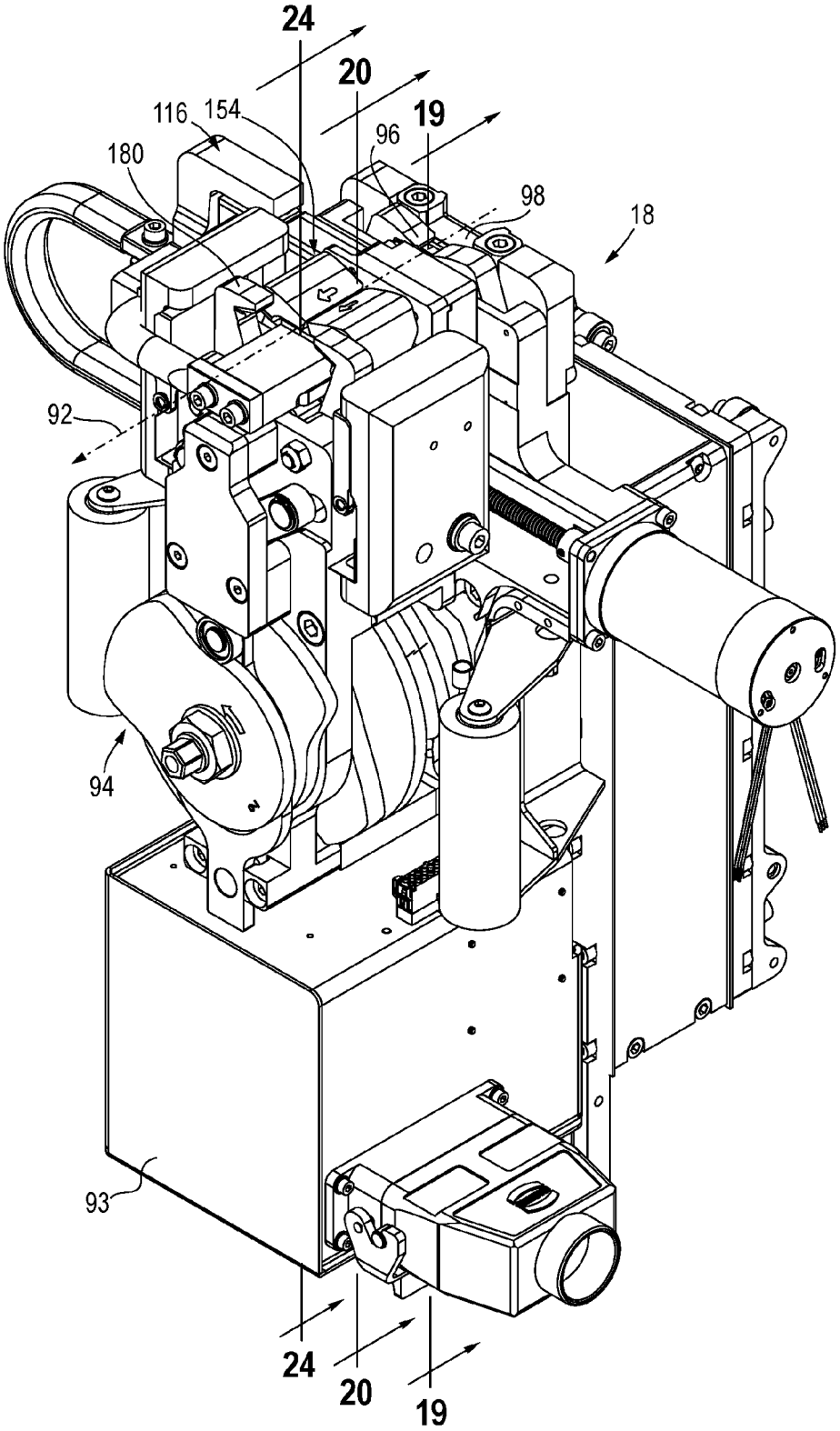
FIG. 18 is a perspective view of the sealing head.
Figure 19:
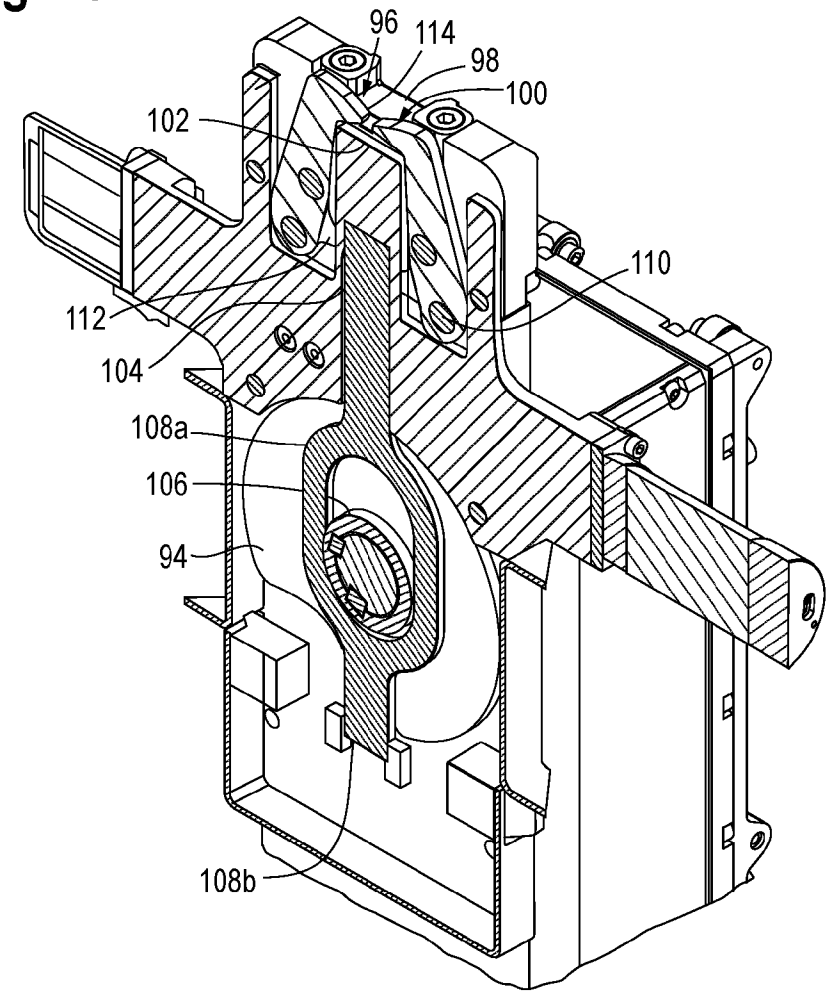
FIG. 19 is a partial sectional view of the sealing head, taken along line 19-19 of FIG. 18, showing the end grip.
Figure 21:
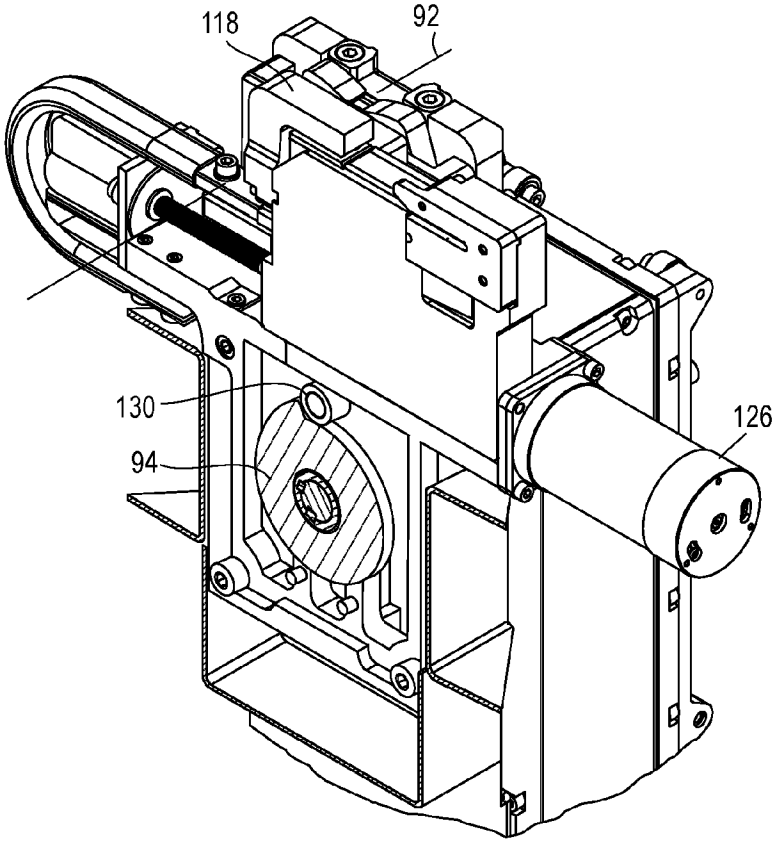
FIG. 21 is a partial sectional view of the sealing head similar to FIG. 20, showing the shuttle in the gripping position for welding.
Figure 20:
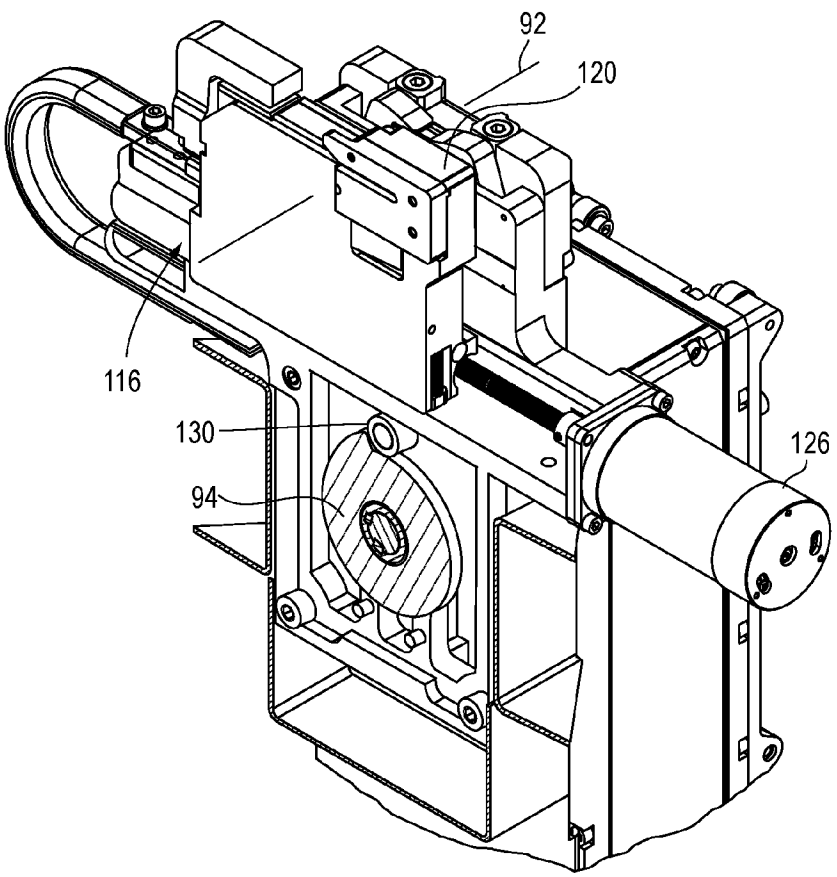
FIG. 20 is a partial sectional view of the sealing head, taken along line 20-20 of FIG. 18, showing the grip clamp/cutter shuttle in the cutting position.

Referring to FIG. 18, an end grip 96 is at the inlet 98 to the sealing head 18. The end grip 96 includes a pair of jaws 100 that define an upper guide 102 of the strap path 92. The end grip jaws 100 move between an open position in which strap S is received by the jaws 100 and a closed position in which the jaws 100 cycle down and the leading end of the strap S is captured between the jaws 100 and an anvil 102. The anvil 102 is formed as part of a link 104 that moves with the end grip jaws 100 between the open and closed positions.

The end grip jaws 100 and anvil 102 (and anvil link 104) move between the open and closed positions by a dual-acting cam 106 having a pair of cam followers **108*a* and 108*b*. A first cam follower 108*a* on the link 104 moves the anvil 102 and end grip jaws into the closed position and a second cam follower 108*b*, on an opposite side of the link 104 move the anvil 102 and end grip jaws 100** into the open position.

The jaws 100 pivot about a pivot joint 110, such as the illustrated pivot pin. Link arms 112 extend from the anvil link 104 to the jaws 100 to pivot the jaws 100. As the anvil link 104 moves upwardly (following the cam follower **108*a*) to move the anvil 102 toward the strap path 92, the link arms 112 pivot the base of the end grip jaws 100 outwardly which in turn pivots a gripping portion 114 of the jaws 100 inwardly onto the strap S. Conversely, as the cam 94 continues to rotate and the opposing cam follower 108*b* contacts the link 104, it moves the anvil link 104 (and thus the anvil 102) downwardly and pivots the jaws 100 to open the end grip 96**.

Adjacent to the end grip 96 is a grip clamp/cutter shuttle 116 that includes a grip clamp 118 and a cutter 120. The shuttle is illustrated generally in FIGS. 20-23, which illustrate the cutter stationary portion or anvil 122 and the grip clamp 118. The shuttle 116 is movable transverse to the strap path 92 to move the cutter 120 into the strap path 92 to cut the strap S (from the supply to form the loop end) and to move the grip clamp 118 into place during the weld cycle. A present shuttle 116 has three transverse positions that lie on the strap path 92: the cutting position (illustrated in FIG. 20); the welding position (FIG. 21); and a home or intermediate position between the cutting and welding positions. The shuttle 116 includes a drive 126, such as the illustrated screw drive, to carry out the transverse movement.

The cutter 120 includes the stationary cutter anvil 122 and a movable cutter blade 128 that moves between a home or retracted position and a cutting position in which the cutter blade 128 moves (upwardly) toward the anvil 122 to cut the strap S. The cutter blade 128 is driven by a cam follower 130 cooperating with the rotating cam 94 to move toward the strap path 92. The cutter blade 128 is returned to the home position by a biasing element, such as the illustrated springs 132 (see, FIG. 22).

The grip clamp 118 is fixedly mounted to the shuttle 116 and a grip clamp anvil 134 moves between a home position and a clamping position, toward the grip clamp 118, to capture the strap S between the grip clamp 118 and the anvil 134 during the welding cycle. The anvil 134 is biasedly mounted within the shuttle 116 to a retracted position by a spring 136. The anvil 134 includes a conductor surface or electrode 138 thereon to conduct current during the welding cycle.

Figure 22:
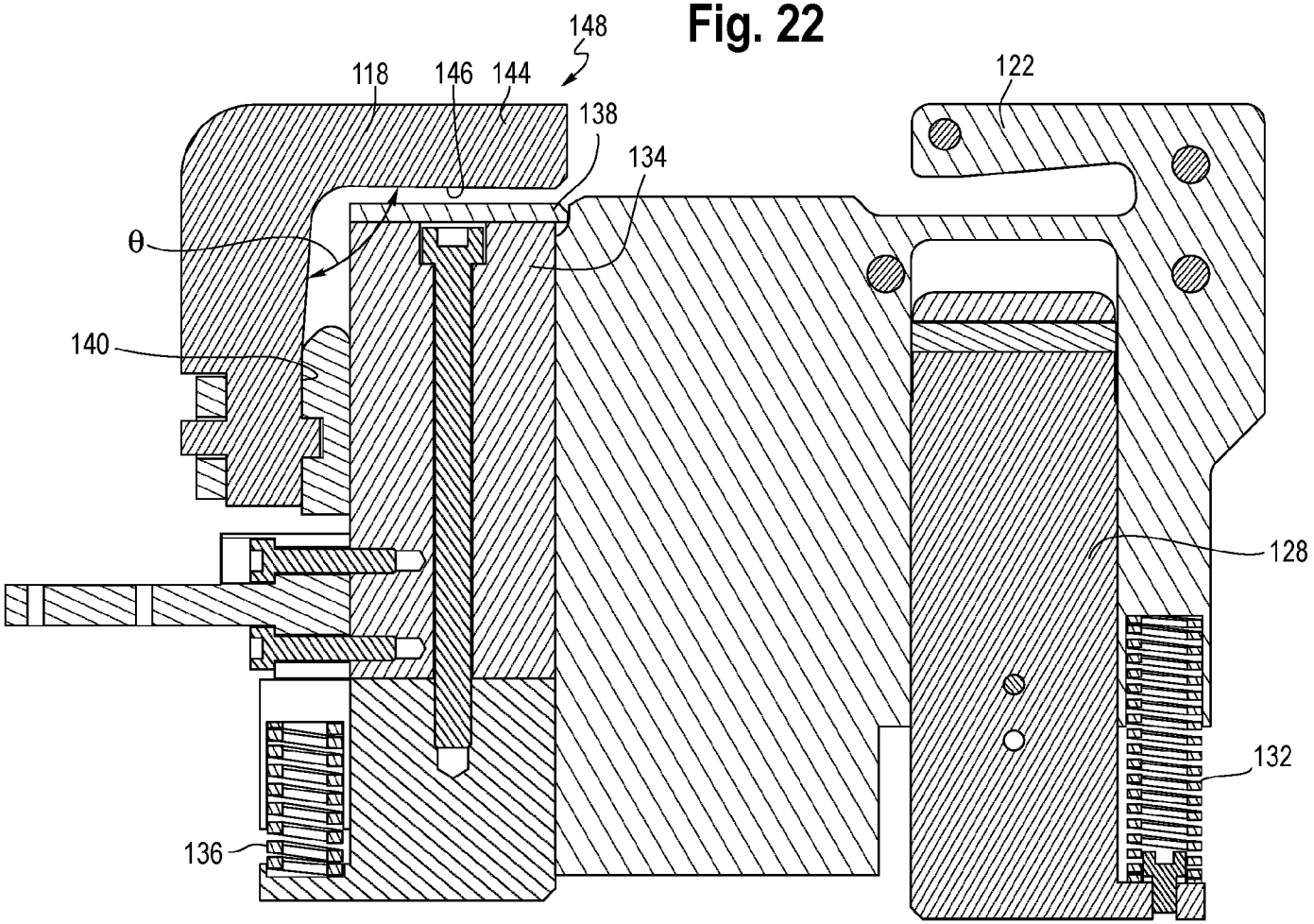
FIG. 22 is a sectional view of the grip clamp/cutter shuttle.
Figure 23:
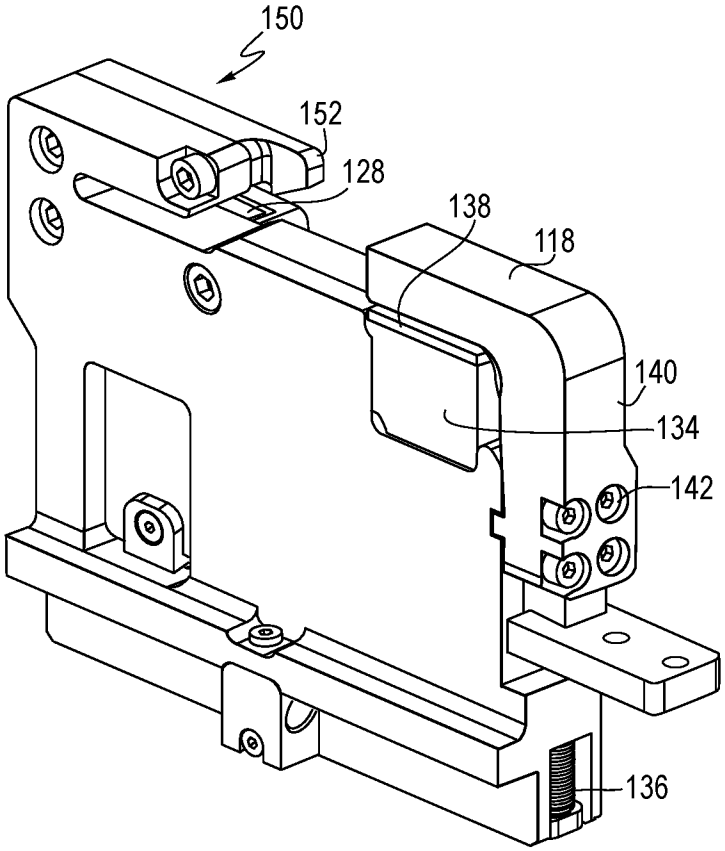
FIG. 23 is a perspective view of the grip clamp/cutter shuttle.

The grip clamp 118, which is best seen in FIG. 22, includes a base portion 140 that is mounted to the shuttle 116 by, for example, fasteners 142 (see, FIG. 23), and a cantilevered clamp portion 144 that extends over the strap path 92. The grip clamp 118 serves to secure the strap S against the anvil 134 during the welding cycle. As best seen in FIG. 22, the grip clamp 118 is formed having a contact surface 146 that, when in a relaxed state, is slightly biased or angled (as indicted at θ) toward the anvil 134. It will be appreciated by those skilled in the art that a significant force must be exerted on the grip clamp 118 during the welding cycle to assure maximum contact between the strap S and the electrode 138. As such, it is desirable to position as much surface area of the grip clamp 118 as practical on the strap S. Given that such parts (and in particular cantilevered parts) will flex with increasing pressure applied to the cantilevered end 146, the end 146 is biased or slightly angled, at the free end 148, toward the electrode 138 (anvil 134). This assures that as the cantilevered end 148 flexes, the grip clamp 118 remains flat when in contact with the strap S.

An end stop 150 is formed as part of the shuttle 116. The end stop 150 moves transversely with the shuttle 116, and includes a stop surface 152 that the leading end of the strap S contacts as it returns to the sealing head 18 (subsequent to traversing through the strap chute 20).

A loop grip 154 is adjacent to the stop surface 152. The loop grip 154 serves to secure the strap end cut from the supply (the loop end of the strap), and, during the welding cycle, move the loop end toward the leading end of the strap and provide a conductor surface or electrode 156 for carrying out the strap weld. The loop grip 154 is carried on a carriage 158 and includes a pair of loop grip jaws 160 that also define an upper guide of the strap path 92. The loop grip jaws 160 move between an open position in which strap S moves through the sealing head 18 and a closed position in which the loop grip jaws 160 move into contact with, and capture the strap S against an anvil 162. The loop grip jaws 160 can be provided with teeth 161 to secure the strap S against the anvil 162. The loop grip anvil 162 is formed as part of the carriage 158 and includes the electrode 156 against which the strap S is secured for conduct of current during the welding cycle. The loop grip 154 includes a link 164 that moves with the loop grip jaws 160 between the open and closed positions.

The loop grip carriage 158, which includes the loop grip jaws 160 and anvil 162 (and the loop grip link 164) moves between the open and closed position by a dual-acting cam 166, having a pair of cam followers 168*a* and 168*b*. A first cam follower 168*a* on the loop grip link 164 moves the anvil 162 and loop grip jaws 160 into the closed position and a second cam follower 168*b* on an opposite side of the link 164 moves the anvil 162 and loop grip jaws 160 into the open position.

The loop grip jaws 160 pivot about a pivot joint, such as the illustrated pivot pin 170. Link arms 172 extend from the anvil link 164 to the jaws 160 to pivot the jaws 160. As the anvil link 164 moves upwardly (following the cam follower 168*a*) to move the anvil 162 toward the strap path 92, the link arms 172 pivot the base of the jaws 160 outwardly which in turn pivots the upper portion of the jaws 160 inwardly to secure the strap S against the anvil 162. Conversely, as the cam 166 continues to rotate and the opposing cam follower 168*b* contacts the link 164, it moves the anvil link 164 (and thus the anvil 162) downwardly and moves the link arms 172 to open loop grip jaws 160.

To carry out movement of the strap ends toward one another, the loop grip carriage 158 moves longitudinally along, that is in the direction of, the strap path 92. Accordingly, the carriage 158 includes an inclined or wedge surface 174 that cooperates with an actuating wedge element 176 actuated by the cam 94. As the actuating wedge 176 moves into contact with the carriage wedge 174, the carriage 158 is urged toward the end grip 96 to, as will be discussed in more detail below, move the loop end of the strap S toward the leading end for sealing. The actuating wedge 176 is also configured with a dual-acting cam 178 to provide positive, driven movement between the engaged and disengaged positions to positively drive the loop grip carriage 158 between the gripping and welding positions.

Figure 24:
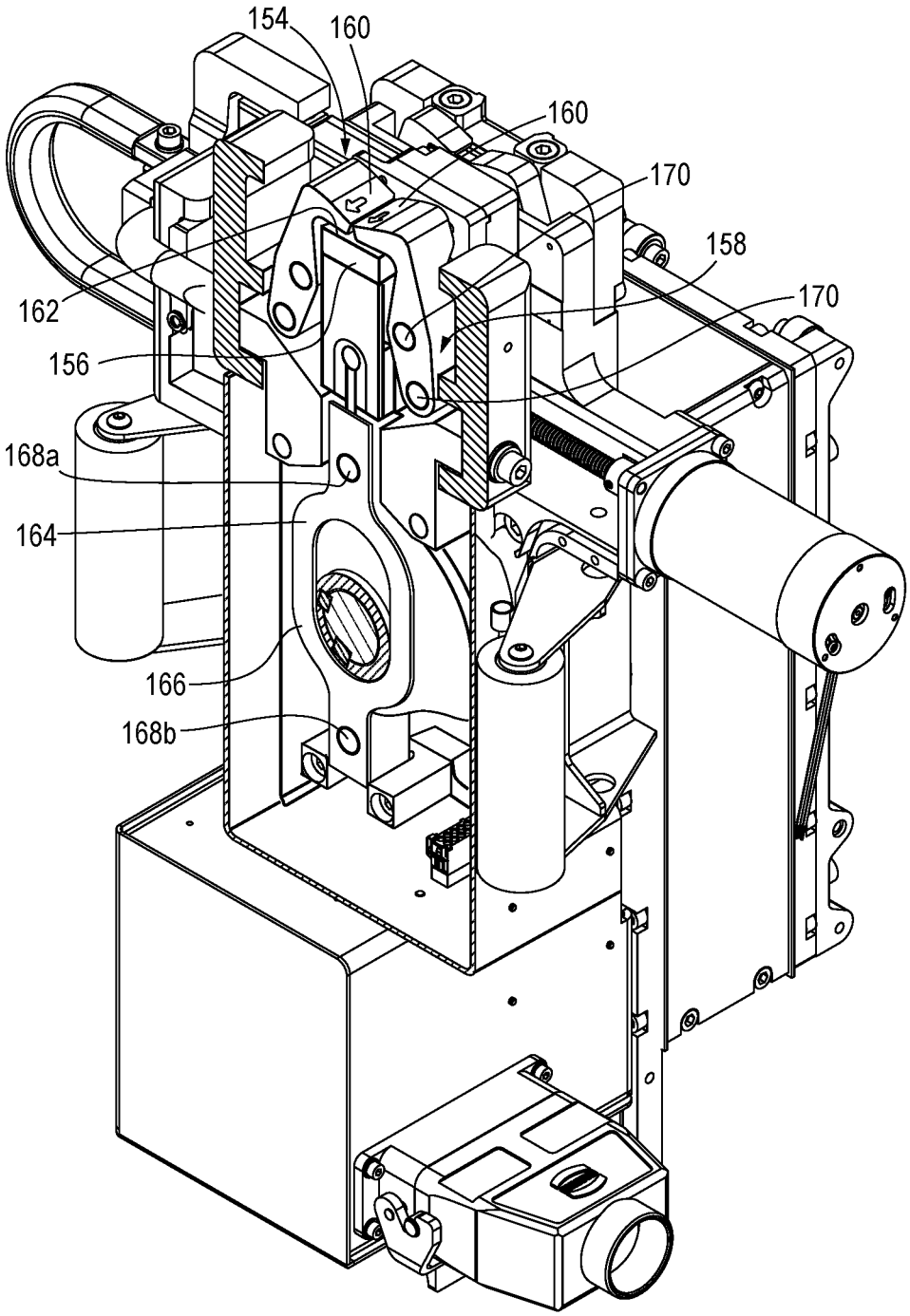
FIG. 24 is a sectional view of the sealing head, taken along line 24-24 of FIG. 18, illustrating the cam drive for the head and the loop grip and carriage.
Figure 25:
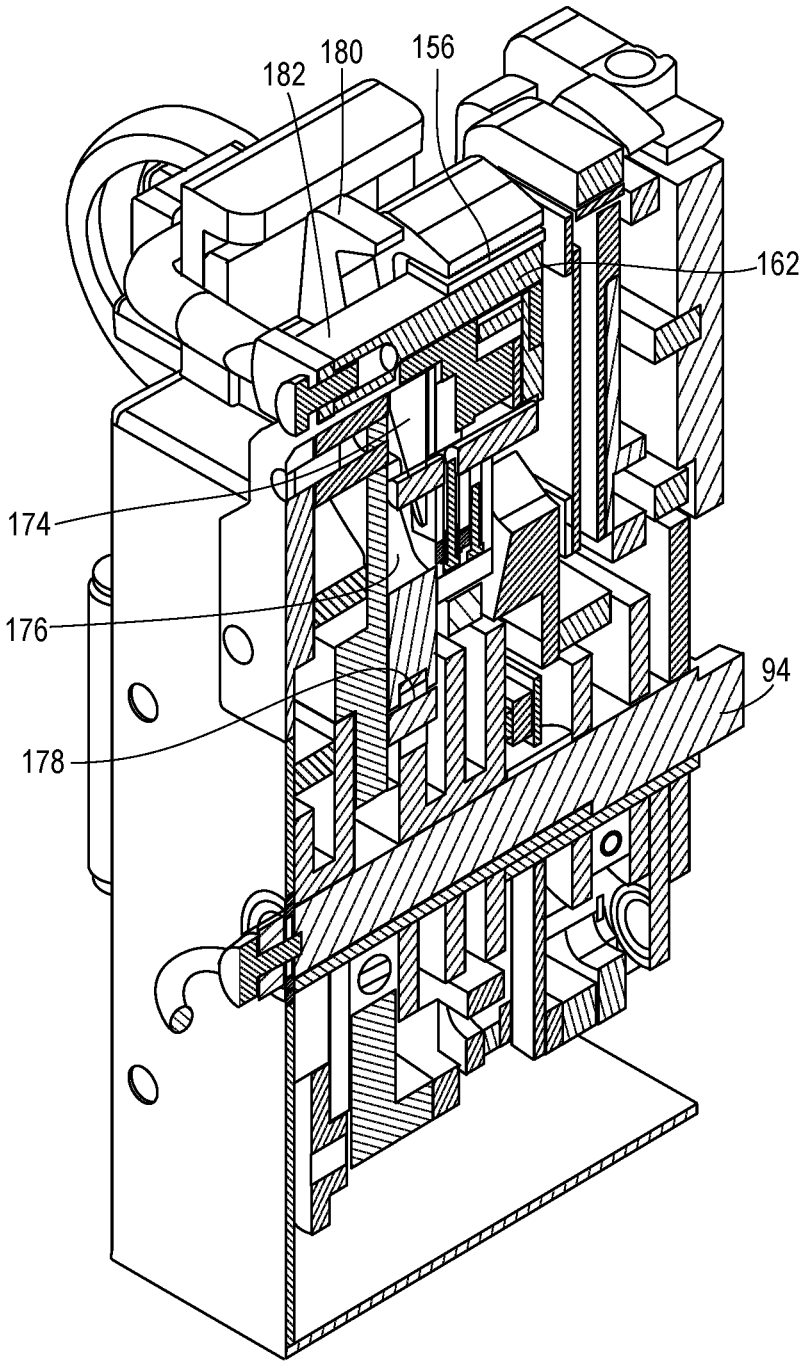
FIG. 25 is a side sectional view of the loop grip carriage.
Figure 26:
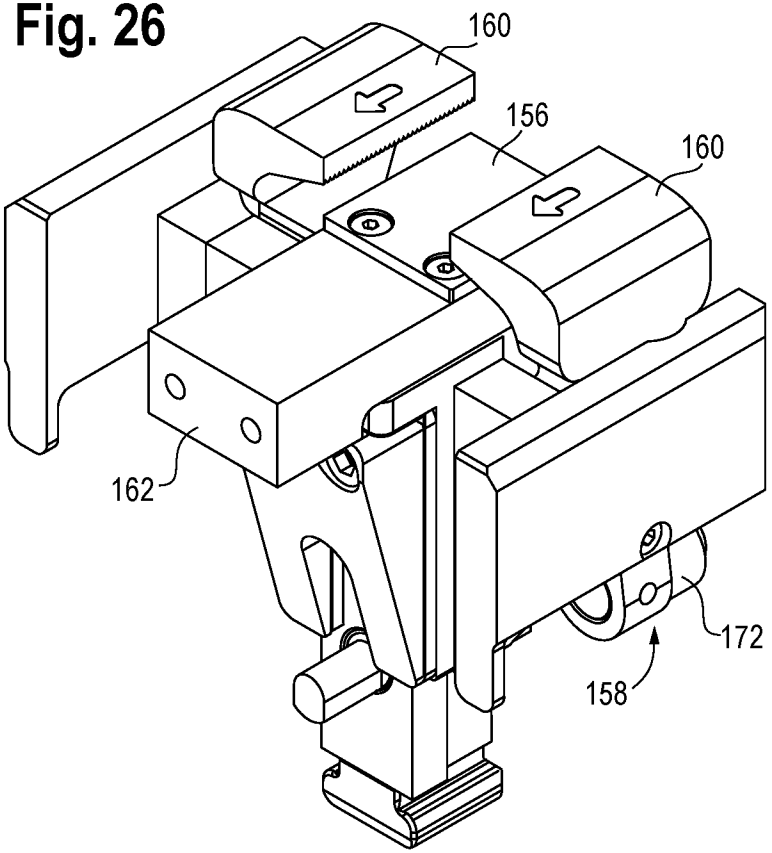
FIG. 26 is a perspective view of the loop grip carriage.
Figure 28:
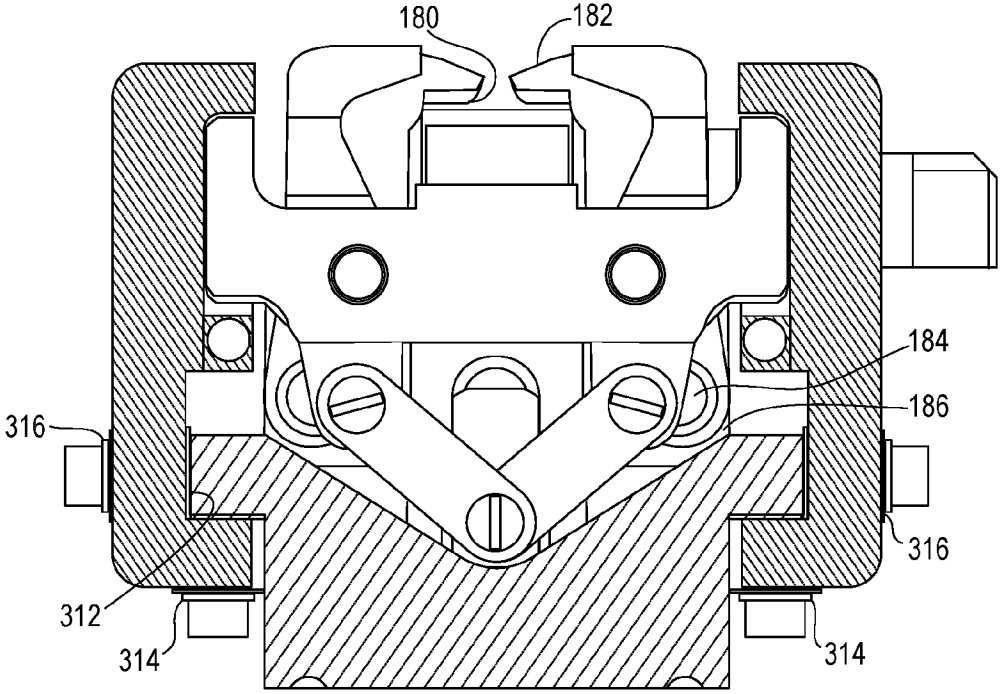
FIG. 28 is front view, in partial section, of the loop grip carriage.
Figure 27:
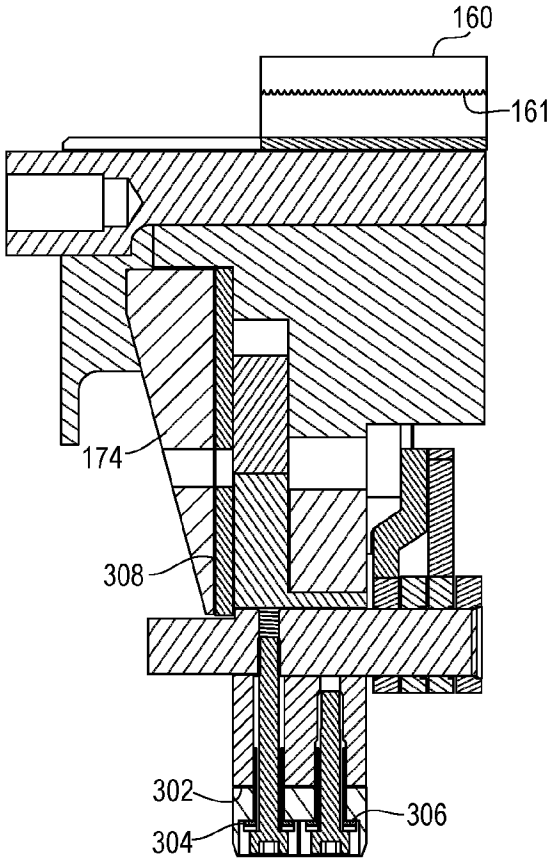
FIG. 27 is a side sectional view of the loop grip carriage.
Figure 29:
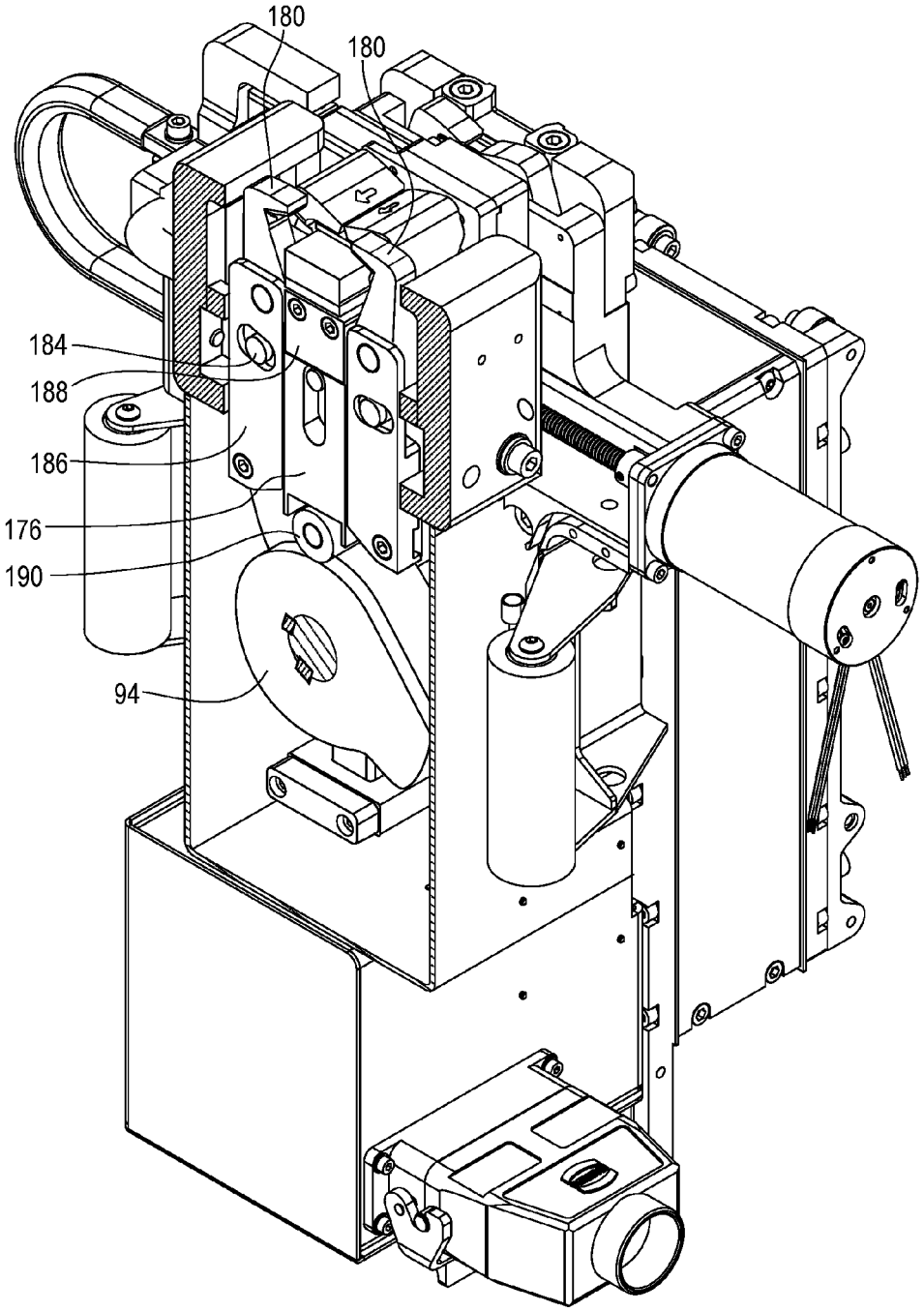
FIG. 29 is a sectional view of the sealing head through the spacer jaws.
Figure 30:
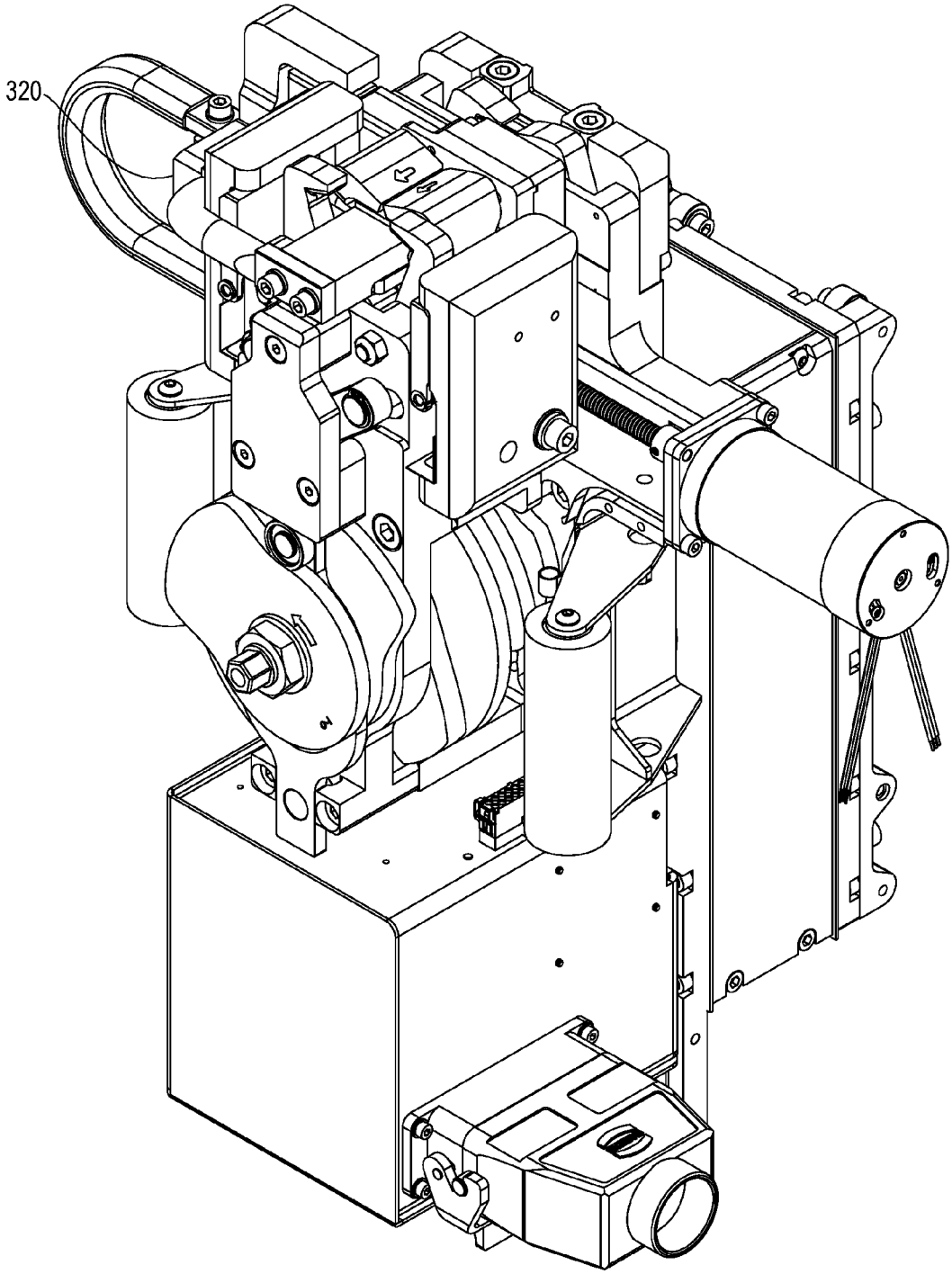
FIG. 30 is a perspective view showing the conductors for the loop grip side electrode.
Figure 31:
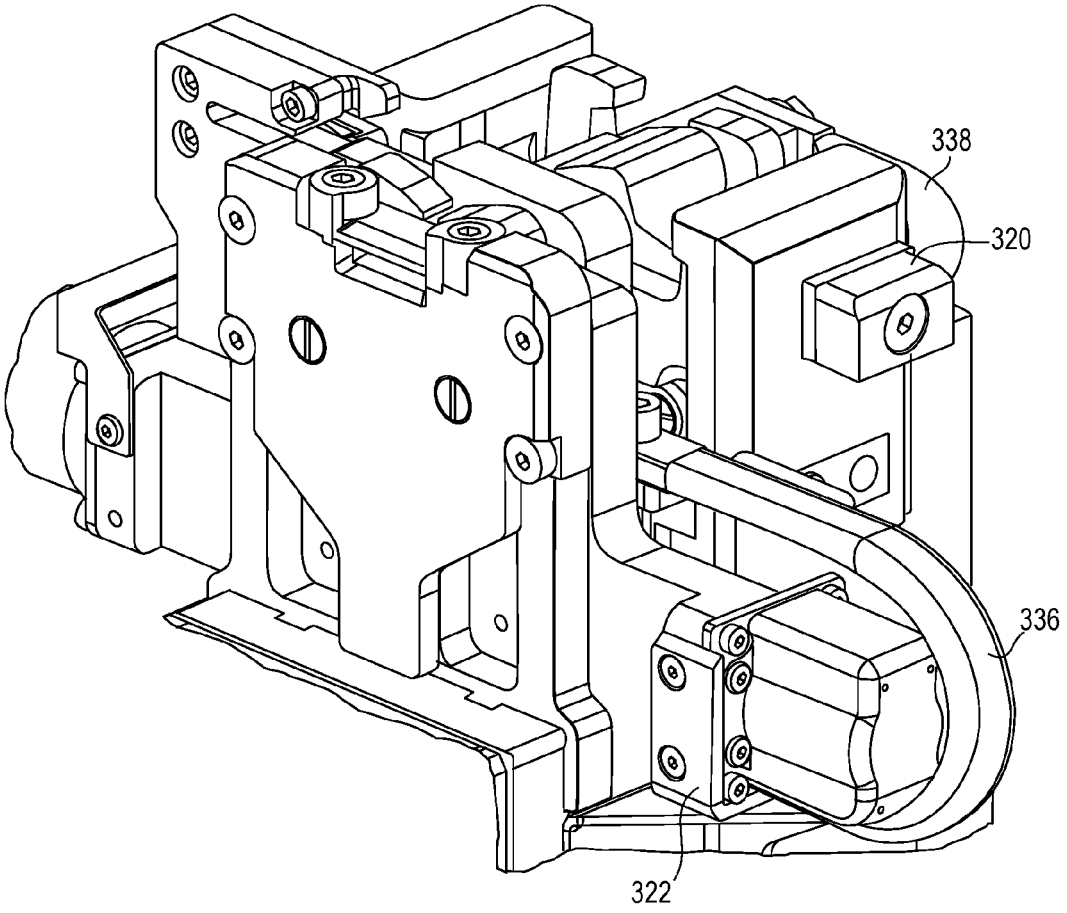
FIG. 31 is another perspective view showing the conductors for the loop grip side electrode

A pair of spacer jaws 180 are adjacent to the loop grip jaws 160, as seen in FIG. 24. The spacer jaws 180 serve a guide function for the loop strap as it traverses through the sealing head 18. As such, the spacer jaws 180 do not bear down on the S strap, but define a gap 182 between the jaws 180 in the closed position and the loop grip anvil 162. The spacer jaws 180 have a pivoting configuration similar to that of the loop grip jaws 160. The spacer jaws 180 pivot about a pivot joint, such as the illustrated pivot pin 184. Link arms 186 extends from a lifter 188 mounted to a cam follower 190 to pivot the jaws 180. As the lifter 188 moves upwardly (following the cam follower 190) toward (but not into the strap path 92), the link arms 186 pivot the base of the jaws 180 outwardly which in turn pivots the jaws 180 inwardly toward the strap path 92.

In order to weld the strap ends to one another, as set forth above, two electrodes 138 and 156 are provided. One electrode 138 is provided on the grip clamp anvil 134 and the other electrode 156 is provided on loop grip anvil 162. The electrode 156 is electrically isolated from the sealing head 18 structure so that current is carried by (conducted through) the electrode 156, only. Accordingly, electrical isolation is provided at the loop grip electrode 156 by isolation elements 302, 304, 306, 308, 310, 312, 314, 316 and 318.

In order to enhance the modularity of the sealing head 18 and the machine 10, generally, connections to the sealing head electrodes 138 and 156 are of the quick-connect type. In such an arrangement, there are two electrical contacts 320 and 322 on the sealing head. These are made of a highly conductive material to minimize resistance and surface area requirements. They are positioned in such a way that when the sealing head 18 is installed on the machine 10, they nest with cooperating biased contacts.

In operation, the leading end of the strap S enters the feed head 14 from the dispenser and is conveyed to the tension head 16 by the feed head 14. A transition guide 192 extends from the tension head 16 to the sealing head 18 and provides the curved or arcuate guide for the strap S from the tension head 16 to the sealing head 18.

As the leading end of the strap S is fed into the sealing head 18, the end grip jaws 100 are open, the cutter shuttle 116 is in the intermediate or home position, the loop grip jaws 160 are open and the spacer jaws 160 are open. The end grip and loop grip anvils 102 and 162 are in their retracted positions.

The leading end of the strap S passes through the sealing head 18 and traverses through the chute 20, the feed limit assembly 74, and back to the sealing head 18. The leading end of the strap S is sensed by the feed limit assembly sensor 74, which signals (through the controller 22) to the feed head 14 that the feed cycle is nearing completion. The feed limit assembly drive 76 is actuated (or it may be running previously) to urge the leading end of the strap into the sealing head 18. The leading end is stopped by stop surface 152, the end grip jaws 100 close on the leading end and the spacer jaws 180 close over (but do not bind on) the loop portion of the strap S to form a guide for the loop portion.

The feed head 14 then operates in reverse to draw the strap S from chute 20 onto the load in a take-up cycle. Once the strap S is sensed to be on the load (for example, by the feed head drive 24 stalling out in the reverse direction), the tension head 16 operates to draw tension in the strap S. When a desired tension is reached, the tension head 16 stops and operates in reverse to roll back the strap a small amount (about 7 mm) to account for the strap consumed during the welding cycle. The loop grip jaws 160 close on the strap S to grip the strap S and the tension head drive 36 turns off. The spacer jaws 180 then open.

The grip clamp/cutter shuttle 116 moves from the home position to the cut position and the loop strap is cut with a small gap (e.g., about ½ mm) between the strap leading end and the cut loop end. The strap S is now ready for welding, and the shuttle 116 moves to the welding position. The grip clamp 124 slides over the loop end of the strap and the grip clamp anvil 134 moves up to clamp the strap S between the grip clamp 118 and the electrode 138 on the grip clamp anvil 134.

The weld transformer turns on and the wedge element 176 begins to move upwardly to engage the wedge surface 174 (on the carriage 158) to move the loop grip carriage 158 longitudinally toward the end grip 96 and the strap leading end. For about half of the longitudinal movement, the carriage 158 moves slowly and the strap S is heated. For about the second half of the longitudinal movement, the transformer turns off, and the loop cut end of the strap, which is heated, moves quickly into the leading end to fuse the strap ends to one another. The overall movement of loop grip carriage is about 7 mm over a period of about 2 seconds. The weld is completed upon completion of the movement of the loop grip carriage 158.

After the weld cycle, following a predetermined period of time, the end grip 102 anvil moves downward away from the end grip jaws 100 and the end grip jaws 100 open, the grip clamp anvil 134 is returned to the retracted position (by spring 136) and the grip clamp/cutter shuttle 116 returns to the home position. The loop grip anvil 162 moves downward away from the loop grip jaws 160 and the loop grip jaws 160 open, and the strapped load is moved or removed from the strapping machine. The machine is then ready for a subsequent strapping cycle.

It will be appreciated by those skilled in the art that the relative directional terms such as upper, lower, rearward, forward and the like are for explanatory purposes only and are not intended to limit the scope of the disclosure.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present disclosure. It is to be understood that no limitation with respect to the specific embodiments illustrated is intended or should be inferred. The disclosure is intended to cover all such modifications as fall within the scope of the claims.

What is claimed is:

1. A self-actuating tension head for a strapping machine for feeding a steel strapping material around a load, tensioning the strapping material, and sealing the strapping material to itself, the tension head comprising:

a body defining a strap path therethrough;

a drive wheel defining a drive wheel axis of rotation;

a tension wheel defining a tension wheel axis of rotation, the drive wheel axis of rotation being a fixed distance from the tension wheel axis of rotation, the drive wheel and the tension wheel being operably engaged with one another;

a pinch wheel defining a pinch wheel axis of rotation, the strap path extending between the tension wheel and the pinch wheel;

a first link operably connecting the drive wheel and the tension wheel, the first link being pivotable about the drive wheel axis of rotation;

a cam operably mounted to the tension wheel, the cam configured for engagement with a cam follower to rotate the first link to move the tension wheel out of engagement with the pinch wheel; and a biasing assembly configured to prevent rotation of the cam about the tension wheel axis of rotation and maintain the cam in a rotational position relative to the cam follower while the tension wheel rotates in a tension direction.

2. The tension head of claim 1 wherein the cam is mounted to the tension wheel by a one-way clutch, the one way clutch permitting the tension wheel to rotate free of the cam in the tension direction and engaging the cam with the tension wheel in an opposite direction.

3. The tension head of claim 2 wherein the cam has a plurality of lobes and a plurality of valleys between adjacent lobes, and wherein the biasing assembly is configured to maintain the cam in the rotational position such that an upstream end of one of the plurality of valleys is positioned on the cam follower at a beginning of a tensioning cycle.

4. The tension head of claim 1 wherein the biasing assembly includes a polymeric element.

5. The tension head of claim 4 wherein the polymeric element is operably mounted to the tension wheel by a spring washer.

6. The tension head of claim 5 wherein the polymeric element is a polymeric disk and wherein the polymeric disk is positioned between a pair of washers forming a sandwich, the sandwich being operably mounted to the tension wheel by the spring washer.

7. The tension head of claim 4 wherein the polymeric element is formed from a polytetrafluoroethylene material.

8. The tension head of claim 6 wherein the polymeric disk is formed from a polytetrafluoroethylene material and the washers are formed from metal.

9. The tension head of claim 1 wherein the biasing assembly includes a plunger biased into engagement with the cam.

10. The tension head of claim 9 wherein the plunger includes a roller at an end thereof for engaging the cam.

11. The tension head of claim 1, further comprising a second biasing element that biases the tension wheel toward the pinch wheel.

12. A self-actuating tension head for a strapping machine for feeding a steel strapping material around a load, tensioning the strapping material, and sealing the strapping material to itself, the tension head comprising:

a body defining a strap path therethrough;

a drive wheel defining a drive wheel axis of rotation;

a tension wheel defining a tension wheel axis of rotation, the drive wheel axis of rotation being a fixed distance from the tension wheel axis of rotation, the drive wheel and the tension wheel being operably engaged with one another;

a pinch wheel defining a pinch wheel axis of rotation, the strap path extending between the tension wheel and the pinch wheel;

a first link operably connecting the drive wheel and the tension wheel, the first link being pivotable about the drive wheel axis of rotation;

a cam operably mounted to the tension wheel, the cam configured for engagement with a cam follower to rotate the first link to move the tension wheel out of engagement with the pinch wheel; and a biasing assembly cooperating with the cam to maintain the cam in a position relative to the cam follower, wherein the biasing assembly includes a polymeric disk positioned between a pair of washers forming a sandwich, the sandwich being operably mounted to the tension wheel by a spring washer.

13. The tension head of claim 12 wherein the polymeric disk is formed from a polytetrafluoroethylene material and the washers are formed from metal.

* * * * *